US010668636B2

(12) United States Patent
Krenik

(10) Patent No.: US 10,668,636 B2
(45) Date of Patent: Jun. 2, 2020

(54) CUTTER HEAD FOR AUTOMATED HAIR CUTTING SYSTEM

(71) Applicant: Matthew W. Krenik, Garland, TX (US)

(72) Inventor: Matthew W. Krenik, Garland, TX (US)

( * ) Notice: Subject to any disclaimer, the term of this patent is extended or adjusted under 35 U.S.C. 154(b) by 327 days.

(21) Appl. No.: 14/051,201

(22) Filed: Oct. 10, 2013

(65) Prior Publication Data

US 2014/0102271 A1 Apr. 17, 2014

Related U.S. Application Data

(60) Provisional application No. 61/713,724, filed on Oct. 15, 2012, provisional application No. 61/780,086, filed on Mar. 13, 2013.

(51) Int. Cl.

| | |
|---|---|
| ***B26B 19/38*** | (2006.01) |
| ***B26B 19/42*** | (2006.01) |
| ***B26B 21/40*** | (2006.01) |

(52) U.S. Cl.

CPC ..... *B26B 19/42* (2013.01); *B26B 19/38* (2013.01); *B26B 19/3806* (2013.01); *B26B 19/388* (2013.01); *B26B 19/3846* (2013.01); *B26B 21/4081* (2013.01); *Y10T 83/04* (2015.04)

(58) Field of Classification Search

CPC ..... B26B 19/3846; B26B 19/20; B26B 19/38; B26B 19/3853; B26B 19/00; B26B 19/205; B26B 19/3806; B26B 19/388; B26B 21/4081

USPC ..... 83/76.2; 30/225, 355

See application file for complete search history.

(56) References Cited

U.S. PATENT DOCUMENTS

| | | | | |
|---|---|---|---|---|
| 2,264,101 | A * | 11/1941 | Strezoff | B26B 19/066 30/209 |
| 3,054,183 | A | 9/1962 | Zucker | |
| 3,413,985 | A | 12/1968 | Dlouhy et al. | |
| 3,536,079 | A | 10/1970 | Dlouhy et al. | |
| 4,602,542 | A | 7/1986 | Natrasevschi | |
| 6,090,108 | A * | 7/2000 | McBrayer | A61B 18/1445 606/46 |
| 6,434,832 | B1 * | 8/2002 | Garrett | B26B 13/24 30/226 |
| 6,973,931 | B1 | 12/2005 | King | |
| 2004/0004559 | A1 | 1/2004 | Rast | |
| 2007/0107234 | A1 * | 5/2007 | Yao | B26B 19/06 30/201 |
| 2009/0303320 | A1 | 12/2009 | Davis | |
| 2011/0018985 | A1 | 1/2011 | Zhu | |

(Continued)

FOREIGN PATENT DOCUMENTS

| | | | |
|---|---|---|---|
| GB | 2462812 | A | 2/2010 |
| WO | 2013096572 | A1 | 6/2013 |

*Primary Examiner* — Kenneth E Peterson
*Assistant Examiner* — Nhat Chieu Do
(74) *Attorney, Agent, or Firm* — Eldredge Law Firm

(57) ABSTRACT

A cutter head for use with automated hair cutting systems are provided. The cutter head comprises a coupling apparatus for attaching the cutter head to an automated hair cutting device; a top comb comprising a plurality of top cutting members; a bottom comb comprising a plurality of bottom cutting members; and a control apparatus having a plurality of control modes for controlling movement of the top and bottom cutting members.

10 Claims, 21 Drawing Sheets

(56) References Cited

U.S. PATENT DOCUMENTS

| | | | | |
|---|---|---|---|---|
| 2011/0225830 | A1* | 9/2011 | Moseman | B26B 19/3846 30/225 |
| 2012/0234146 | A1* | 9/2012 | Lakin | B26B 19/00 83/76.2 |
| 2013/0031785 | A1* | 2/2013 | Kaupp | A01G 3/053 30/208 |
| 2015/0059187 | A1* | 3/2015 | Krenik | B26B 19/42 30/123 |

* cited by examiner

CUTTER HEAD FOR AUTOMATED HAIR CUTTING SYSTEM

CROSS REFERENCE TO RELATED APPLICATION

This application claims the benefit of U.S. Provisional Application Ser. No. 61/713,724, filed by Matthew W. Krenik on Oct. 15, 2012, entitled "Cutter Head for Automated Hair Cutting System;" and U.S. Provisional Application Ser. No. 61/780,086, filed by Matthew W. Krenik on Mar. 13, 2013, entitled "Techniques for Automated Hair Cutting System."

TECHNICAL FIELD

The present disclosure relates generally to hair cutting systems and methods, and more particularly to a cutter head for use with an automated hair cutting system.

BACKGROUND

International application number PCT/US12/70856, filed by Matthew W. Krenik on Dec. 20, 2012, entitled "Automated Hair Cutting System and Method of Operation Thereof," (hereinafter "Krenik '856") provides a description of automated hair cutting systems. These systems operate by determining the position and/or orientation of a hair cutting device relative to a user receiving a haircut. Hair may be collected in a cutter head and extended for cutting to a beneficial length. Through electronic measurements and computational analysis, the location of where hair on the scalp of a user is collected into a cutter head may be determined and as hair is extended and slides through a cutter head, its length may be substantially determined so that a cutter head may be actuated at a beneficial time to cut hair to a beneficial length.

Krenik '856 relates to a cutter head through which hair may be extended in a combing action for extension to a beneficial length for cutting. However, the cutter heads described in Krenik '856 do not provide a way to automatically adjust the level of pressure or friction that a cutter head applies to hair as it is extended without the addition of an auxiliary comb. Auxiliary combs described in Krenik '856 require an additional structure added to a hair cutting device and while they may be manually or automatically actuated, auxiliary combs will normally require additional actuators or mechanisms for such actuation to take place. Hence, a cutter head that may provide controlled and adjustable levels of friction to hair as it slides through a cutter head without the need for an auxiliary comb is highly desirable.

SUMMARY

Several embodiments of a cutter head for use with automated hair cutting systems are disclosed herein. One embodiment of a cutter head comprises a coupling apparatus for attaching the cutter head to an automated hair cutting device; a top comb comprising a plurality of top cutting members; a bottom comb comprising a plurality of bottom cutting members; and a control apparatus having a plurality of control modes for controlling movement of said top and bottom cutting members. In some embodiments, at least one control mode is configured for controlling both lateral and vertical movement of said top and bottom cutting members.

In another embodiment according to the present disclosure, a method of cutting hair is provided. The method comprises providing an automated hair cutting device; providing a cutter head for coupling on to said hair cutting device. The cutter head comprises a coupling apparatus for attaching the cutter head to an automated hair cutting device; a top comb comprising a plurality of top cutting members; a bottom comb comprising a plurality of bottom cutting members; and a control apparatus having a plurality of control modes for controlling movement of said top and bottom cutting members; and selecting one of plurality of modes on the control apparatus and applying said hair cutting device over hair and manipulating said device through said hair. In some embodiments the mode selected comprises controlling lateral and vertical movement of said top and bottom cutting members such that pressure is applied to hair collected therebetween and said pressure cuts said hair. In other embodiments, the at least one control mode is configured such that top and bottom members are positioned relatively parallel to each other for collecting and compressing hair therebetween, and thereafter moving the top cutting members laterally in order to cut the collected hair. In still other embodiments, the control modes comprise at least a cutting mode, collecting mode, and a manipulating mode.

Accordingly, embodiments of the present disclosure provide cutter head designs for an automated hair cutting system that allow hair to be beneficially manipulated and cut. Embodiments include a cutter head that allows collection of hair, followed by actuation in one direction to apply a controlled level of friction to hair so that it may be more easily manipulated, and to cut hair when actuated in an alternate direction. Additional embodiments include techniques for improved designs of cutter heads including improvements in both top cutter and bottom comb designs. Use of top cutter knives and bottom comb teeth that have slanted edges that allow hair to be cut through the course of a longer stroke of the cutter knives reduce peak load on an actuator driving a cutter head and provides smoother operation with less vibration. Extension of bottom comb teeth beyond the tips of cutter knives in a cutter head improve safety and allow hair to be more easily collected in a cutter head. Comb tooth guards may be beneficial in some embodiments to improve safety by making it more difficult for a person to contact cutter knives. And use of a guard along an end comb tooth of a bottom comb may benefit operation of some embodiments by keeping hair substantially away from sharp edges of cutter knives that may otherwise be exposed. Variable length bottom comb teeth may be used in some embodiments to generate a contoured shape of bottom comb teeth tips and improve the ability to collect hair in a cutter head. Cutter knives including a reinforced edge may improve rigidity of a cutter knife and improve cutting action. The addition of lateral dividers to the tips of cutter knives may improve safety, reduce the likelihood of hair snagging in a cutter head, and improve cutting action. A further embodiment of this invention teaches a shaving accessory that may be applied to a cutter head so that the benefit of position information and control found in an automated hair cutting system may be extended to shaving.

DETAILED DESCRIPTION

Figure 1:
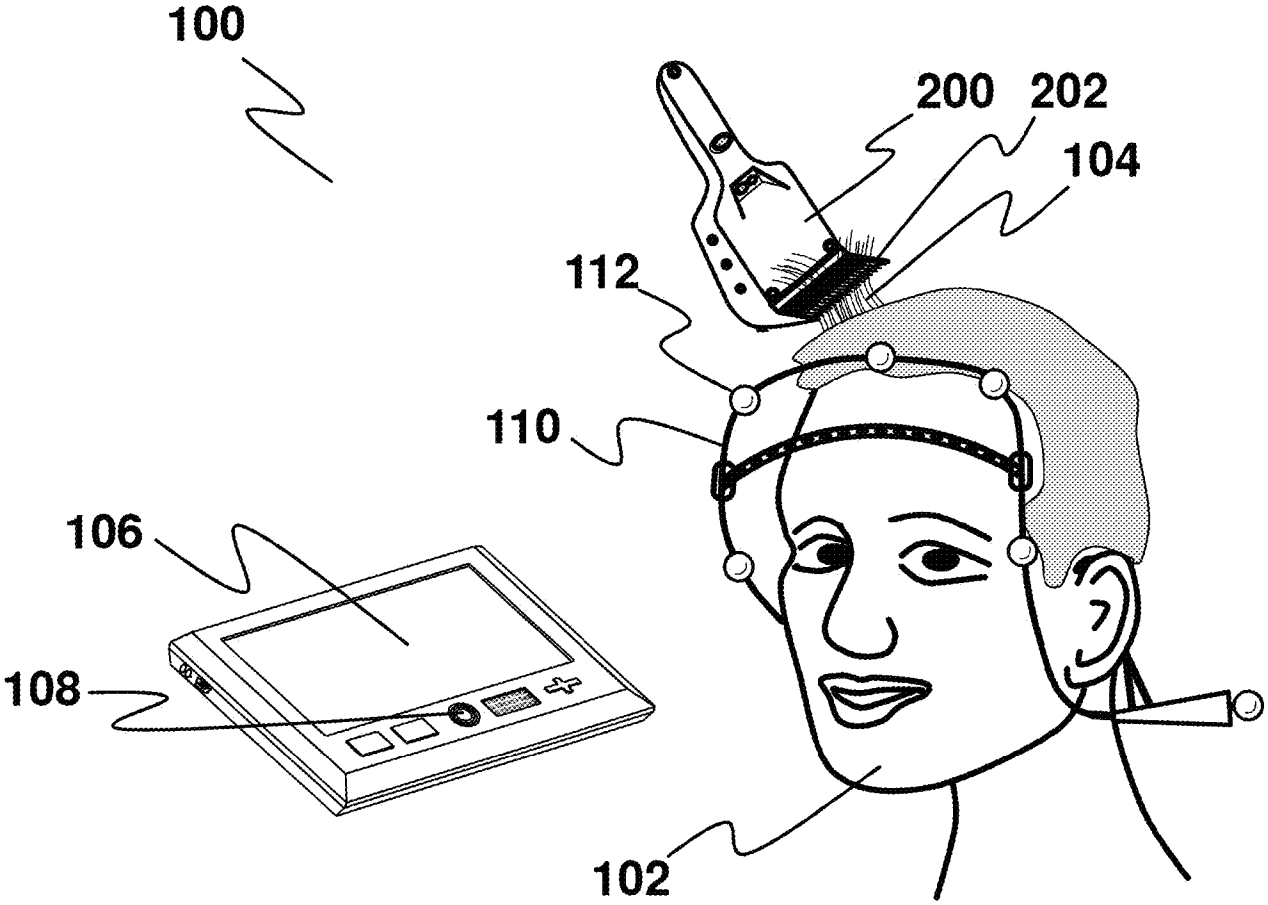
FIG. 1 is an environmental view of an automated hair cutting system having a positioning device, a hair cutting device and an electronic computing device.

FIG. 1 shows an embodiment of an automated hair cutting system 100 cutting a region of hair 104 on a user 102. An electronic computing device 106 including a camera 108 interacts with a positioning device 110 having a plurality of positioning interfaces 112. Hair cutting system 100 comprises a hair cutting device 200 including a cutter head 202. Hair cutting system 100 is described in more detail in Krenik '856. Hair cutting system 100 may operate through observation of and/or interaction with user 102 and/or positioning device 110 by hair cutting device 200 and/or other system elements to substantially allow the position and/or orientation of hair cutting device 200 to be determined relative to the head of user 102 so that selected regions of hair 104 may be substantially collected in a cutter head 202 of hair cutting device 200, extended to a beneficial length, and cut. Additional embodiments, modes of operation and additional description of automated hair cutting system 100 may be found in Krenik '856. Certain embodiments of automated hair cutting system 100 are possible in which no positioning device 110 is utilized and the position and/or orientation of hair cutting device 200 relative to the head of user 102 is determined through use of some combination of cameras, motion sensors, accelerometers, gyroscopes, and other sensors.

As shown in FIG. 1, multiple modes of operation for a cutter head 202 are desired in automated hair cutting system 100. Commonly available hair cutters (including hair clippers, trimmers, vacuum trimmers, etc.) utilize cutter heads that are normally actuated continuously and cut hair substantially immediately as it is introduced into their cutter heads. In contrast, automated hair cutting system 100 may require that a region of hair 104 be collected in a cutter head 202 while the cutter head is close to the user's 102 scalp, so that the location of the collected region of hair 104 may be determined, the region of hair 104 may then slide through the cutter head 202 while it is extended to a beneficial length, and finally, the region of hair may be cut once a beneficial length is reached. Instead of cutting a region of hair 104, it is also possible to use automated hair cutting system 100 to substantially measure the length of region of hair 104. Knowledge of the length of hair of a user 102 may be beneficial for some embodiments as it allows automated hair cutting system 100 to advise a user 102 about possible hair styles based on hair length. It should be clear that the commonly available cutter heads of today do not provide the functions and capability that enable beneficial operation of some embodiments of an automated hair cutting system 100.

The benefit of special cutter heads 202 for hair cutting devices 200 used in an automated hair cutting system such as system 100 may be understood through an example of cutting hair along a hair part. Referring to FIG. 1, if user 102 has a part in their hair (that is, a common hair part where hair is combed in different fashions on either side of a line-like part of the hair; although not shown in FIG. 1), the location of the hair part may be indicated to an automated hair cutting system 100 by placing the front edge of the cutter head 202 of hair cutting device 200 into the part and signaling to the automated hair cutting system 100 (through a button press, touch to a button on electronic computing device 106, or other possible signal). This may be repeated at several locations along the hair part so that the automated hair cutting system 100 has a complete reference for the location of the hair part. Automated hair cutting system 100 may then direct the user 102 to comb the cutter head 202 of hair cutting device 200 up to the edge of the hair part from one side and extend hair for cutting. Automated hair cutting system 100 may monitor when the edge of the hair part is reached and signal to user 102 to stop a forward combing action and begin an extending action to extend hair for cutting. As hair may need to be cut to various lengths along a hair part and to different lengths on either side of a hair part, an automated hair cutting system 100 may monitor the location of cutter head 202 of hair cutting device 200 each time hair is extended. Especially for persons with fine hair or curly hair that may otherwise be difficult to manipulate and may easily fall out of a cutter head, and for the case of cutting hair along a hair part or other feature that requires substantially precise separation and manipulation of hair so that it may be substantially precisely cut, a cutter head with the ability to collect hair in a specific location on a user's 102 head, extend hair and possibly apply friction to it so that it doesn't fall out of the cutter head inadvertently, and cut hair at an appropriate length of extension is highly beneficial.

While embodiments of cutter heads explained in this patent application provide particular benefit for use with an automated hair cutting system 100. The embodiments described herein may also be used with hair cutting devices that are not utilized as part of an automated hair cutting system 100 or are being operated in a manual fashion without benefit of an automated hair cutting system 100.

Figure 2A:
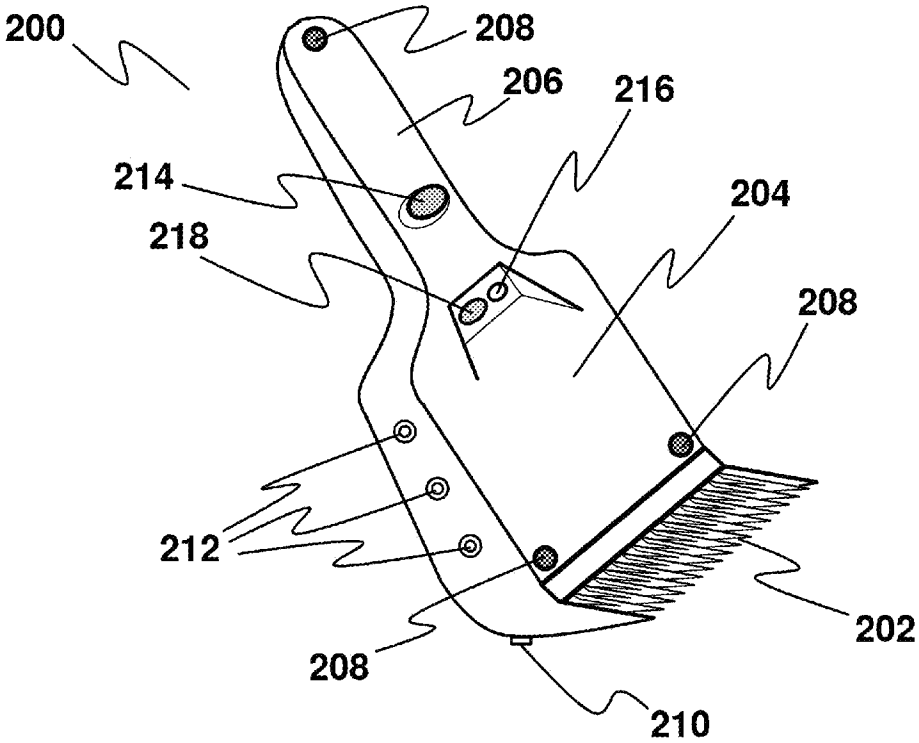
FIG. 2A is a perspective view of another hair cutting device having features suitable for use in an automated hair cutting system.

FIG. 2A shows another embodiment of a hair cutting device 200 including cutter head 202, handle 206, body 204, touch sensor 210, sensors 208, indicator lights 212, camera 216, illumination source 218, and button 214. Hair cutting device 200 operates in automated hair cutting system 100 as described above to collect hair in cutter head 202 and cut it at substantially beneficial times when the collected hair is at a beneficial length. Handle 206 and body 204 provide the main physical structure of hair cutting device 200. Touch sensor 210 allows hair cutting device 200 to monitor when it touches the scalp of a user 102 and may offer additional capability to measure distance from the scalp of user 102 to hair cutting device 200. Sensors 208, camera 216, and illumination source 218 may provide information beneficial information for determining the position and/or orientation of hair cutting device 200 through interaction with or observation of user 102 and/or positioning device 110. Hair cutting device 200 may also include accelerometers, gyroscopes, motion indicators, and other sensors to help in determining the position and/or orientation of hair cutting device 200 with respect to the head of user 102. Indicator lights 212 may provide beneficial signals to a user 102 in the course of operation of automated hair cutting system 100, and button 214 may allow user 102 to stop action of hair cutting device 200 in the event that user 102 no longer wants cutting action to occur or to provide other beneficial signals to automated hair cutting system 100. Further description of embodiments of hair cutting devices are found in Krenik '856.

Figure 2B:
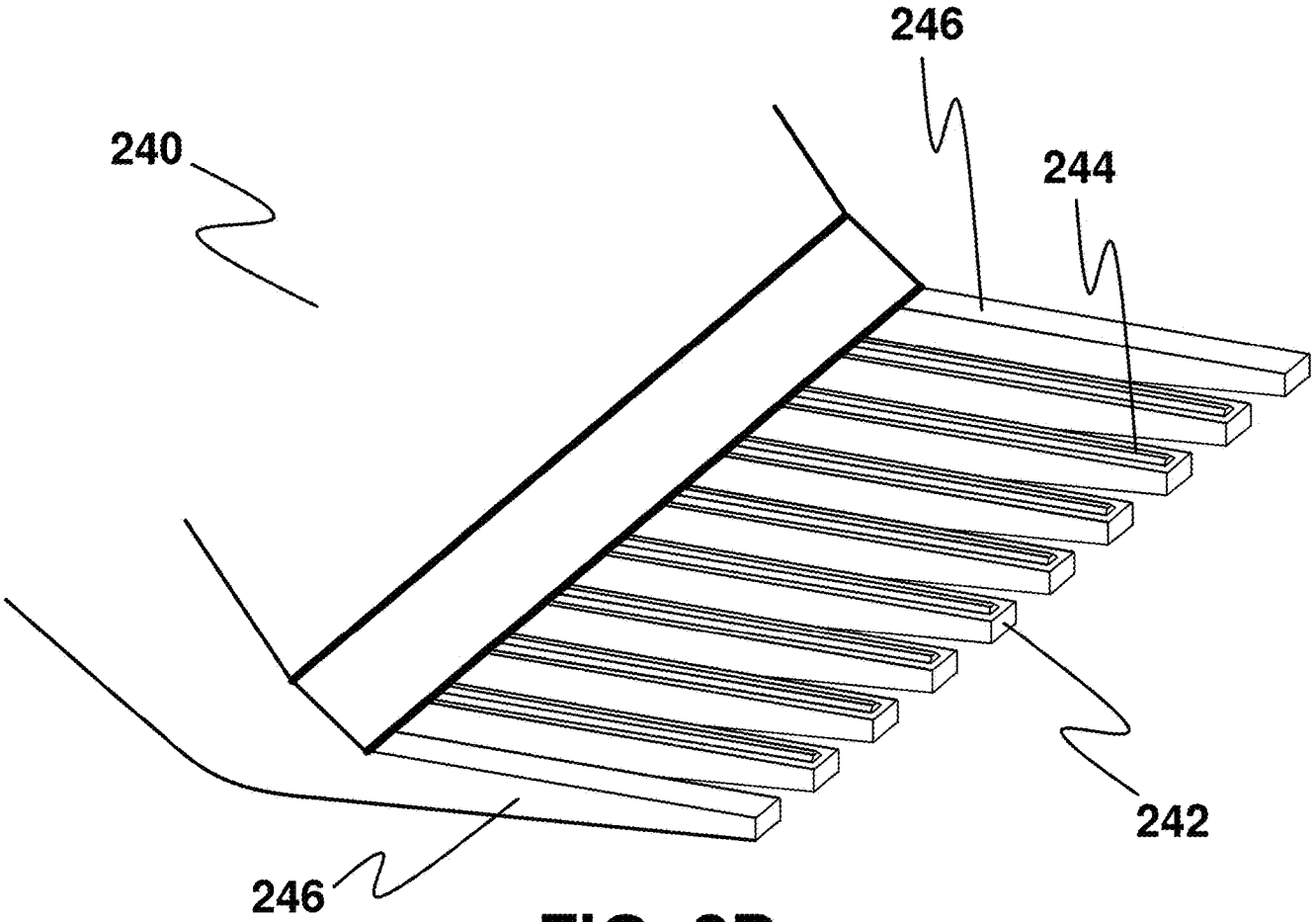
FIG. 2B is a perspective view of cutter head which have heretofore been used with the automated hair cutting systems shown in FIG. 1.

FIG. 2B shows an embodiment of a cutter head 240 heretofore used in hair cutting systems such as hair cutting system 100 shown in FIG. 1. The cutter head 240 comprises a bottom comb having teeth 242 which are spaced to allow hair to enter and to be combed in a conventional way such as how a common hair comb is used. As shown in FIG. 2B, cutter knives 244 are positioned on top of comb teeth 242 such that knives 244 do not interfere with the function of the bottom comb, allowing regions of hair to be engaged and extended. Cutter knives 244 may then be actuated so that they slide over the regions between comb teeth 242 and cut hair that may be present. Cutter knives 244 may be actuated together as a single element, or some embodiments may allow them to be actuated in groups or to be actuated individually. Cutter knives 244 are not shown present on top of end comb teeth 246, but some embodiments may include them. Additional description of a cutter head similar to cutter head 240 is available in Krenik '856.

Figure 3:
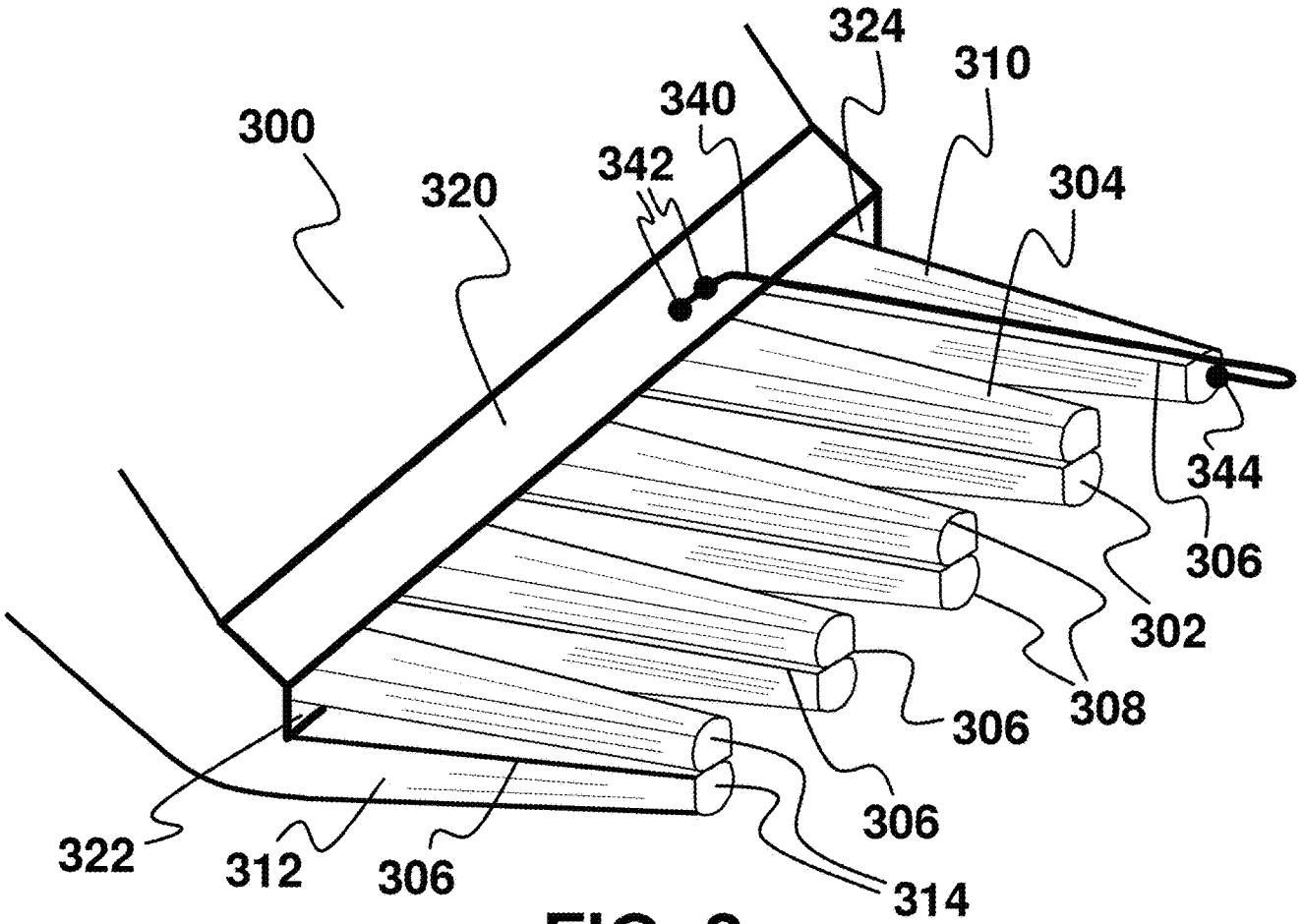
FIG. 3 is a perspective view of one embodiment of a cutter head according to the present disclosure wherein actuation of the cutter knives in a first direction apply pressure and friction to hair which enables beneficial manipulation and cutting thereof.

FIG. 3 shows an embodiment of a cutter head 300 for use in hair cutting devices. Cutter head 300 comprises a plurality of comb teeth 302 and cutter knives 304. Cutter head 300 enables hair to be collected; allows actuation of cutter knives 304 in a first direction to apply pressure and friction to hair so that it may be beneficially manipulated; and to provide cutting action when the cutter knives 304 are actuated in a second direction. Cutter head 300 shown in FIG. 3 includes four cutter knives 304 and five comb teeth 302. Cutter knives 304 are shown above comb teeth 302 so that hair may be collected into cuter head 300. Tips 314 of cutter knives 304 and comb teeth 302 are shown flat in FIG. 3 so that the beneficial cross-sectional shape of cutter knives 304 and comb teeth 302 may be more easily observed, but some embodiments may comprise tapered, rounded, chamfered, or otherwise pointed or finished tips 314. Each cutter knife 304 and each comb tooth 302 include at least one sharp edge 306 beginning near tip 314 and extending the length of cutter knife 304 or comb tooth 302. Other surfaces of cutter knives 304 and comb teeth 302 have rounded edges 308. Hair that may be collected in cutter head 300 may be cut if cutter knives 304 are actuated so that sharp edges 306 of cutter knives 304 meet the sharp edges 306 of comb teeth 302. In FIG. 3, such cutting action may occur if cutter knives 304 are actuated to the right (toward the upper right corner of FIG. 3 for the orientation of cutter head 300 shown in FIG. 3). If cutter knives 304 are actuated to the left (toward the lower left corner of FIG. 3 for the orientation of cutter head 300 shown in FIG. 3), rounded edges 308 of cutter knives 304 and comb teeth 302 will press on hair collected in cutter head 300. Pressure on hair from rounded edges 308 on hair collected in cutter head 300 may help in the ability to manipulate hair collected in cutter head 300. For example, if a person receiving a haircut has curly hair, moderate pressure on hair from rounded edges 308 may provide a level of friction to allow hair to be more easily manipulated and extended. Those skilled in the art will recognize that in addition to providing controlled pressure or friction to hair, actuation of cutter knives 304 to the left may also be utilized to alter the lateral spacing between cutter knives 304 and comb teeth 302 so that hair collected in cutter head 300 is simply confined to narrower spaces versus the spaces available when hair was collected in cutter head 300.

Comb tooth guard 340 in FIG. 3 attaches to body 320 of cutter head 300 through attachments 342, and attaches to a tip of a rightmost end comb tooth 310 through attachment 344. Comb tooth guard 340 may provide benefit in keeping hair collected in cutter head 300 from substantially contacting sharp edge 306 of rightmost end comb tooth 310. During a cutting stroke of cutter head 300, the cutter knife 304 adjacent to comb tooth guard 340 may pass underneath comb tooth guard 340 and avoid directly contacting or colliding with comb tooth guard 340. Some embodiments of cutter head 300 may utilize an additional cutter knife 304 positioned above rightmost end comb tooth 310, but when actuated for cutting, such an additional cutter knife 304 may extend substantially far to the right of rightmost end comb tooth 310 requiring that right body end gap 324 be extended to accommodate the motion of such an additional cutter knife 304. Left body end gap 322 may provide space in cutter head 300 so that cutter knives 304 may be actuated to the left to apply pressure and friction to hair or adjust the size of the lateral openings between comb teeth 302 and cutter knives 304. Actuation of cutter head 300 to the left to apply pressure and friction to hair may not require that rounded edges 308 of cutter knives 304 and comb teeth 302 meet each other (unlike a cutting stroke in which sharp edges 306 of cutter knives 304 and comb teeth 302 may pass each other so that cutting action is achieved), hence, left body end gap 322 above leftmost end comb tooth 312 may have an opening such as to allow motion of cutter knives 304 to allow levels of pressure and friction to be applied to hair.

Cutter heads and cutter head elements including the embodiments according to the present disclosure may be fabricated from a wide range of materials and through use of a wide range of fabrication processes. Cutter head 300 shown in FIG. 3 and other possible cutter head embodiments, may comprise metals including steel, stainless steel, hardened metals, metal alloys, liquid metal alloys, and other metals; ceramics; glass; diamond; metals coated with diamond-like carbon; metals coated with ultra nano-crystalline diamond; metals coated with other diamond-like or diamond coatings; metals or other materials coated with other protective, or hardening coatings; plastics coated with ceramics, metals, or other coatings; plastics or other materials containing metals, diamond, stone, abrasives, or other hard materials; or other possible materials or combinations thereof. Cutter knives 304 and comb teeth 302 may be textured, smoothed, etched, polished, painted, coated, finished with combinations of techniques, or otherwise finished either partially or completely over their surfaces for beneficial results. Cutter knives 304 and comb teeth 302 may comprise different materials, fabricated differently, or finished differently from each other for some cutter head embodiments. Cutter knives 304 and/or comb teeth 302 may also comprise materials and be configured so that they effectively become sharper and more effective through repeated use (such as other common cutting devices that provide "self-sharpening" operation). Body 320 may comprise metals, plastics, wood, or other suitable materials. Comb tooth guard 340 may comprise metals, metal wire, or other suitable materials and attachments 342 and attachment 344 may be formed with metal screws, rivets, welds, adhesive, or other suitable methods for attachment. The elements of cutter head 300 and other possible embodiments of cutter heads may be formed with machining, molding, stamping, polishing, sharpening, grinding, drilling, cutting, injection molding, bonding, laminating, or other suitable processes. Mountings, guides, actuators, mechanism and other elements used to guide and/or actuate a cutter head 300 or other possible cutter head embodiments may comprise low friction materials (such as low-friction plastics, etc.) or may be textured, coated, lubricated, or otherwise finished to provide substantially smooth operation, to minimize mechanical wear, and possibly to provide other benefits.

FIG. 4A through 4F provide additional embodiments of cutter heads with cutter knives and comb teeth that may be used to provide friction or adjust spacing if cutter knives are actuated in a first direction and cutting action if cutter knives are actuated in a second direction. FIG. 4A through 4F provide cross-sectional views looking at cutter knives and comb teeth from the tips 314 either at the tips 314 if flat tips 314 such as those shown in FIG. 3 are utilized, or further back through the cutter knives and comb teeth if other types of tips (as previously noted) are utilized.

Figure 4A:
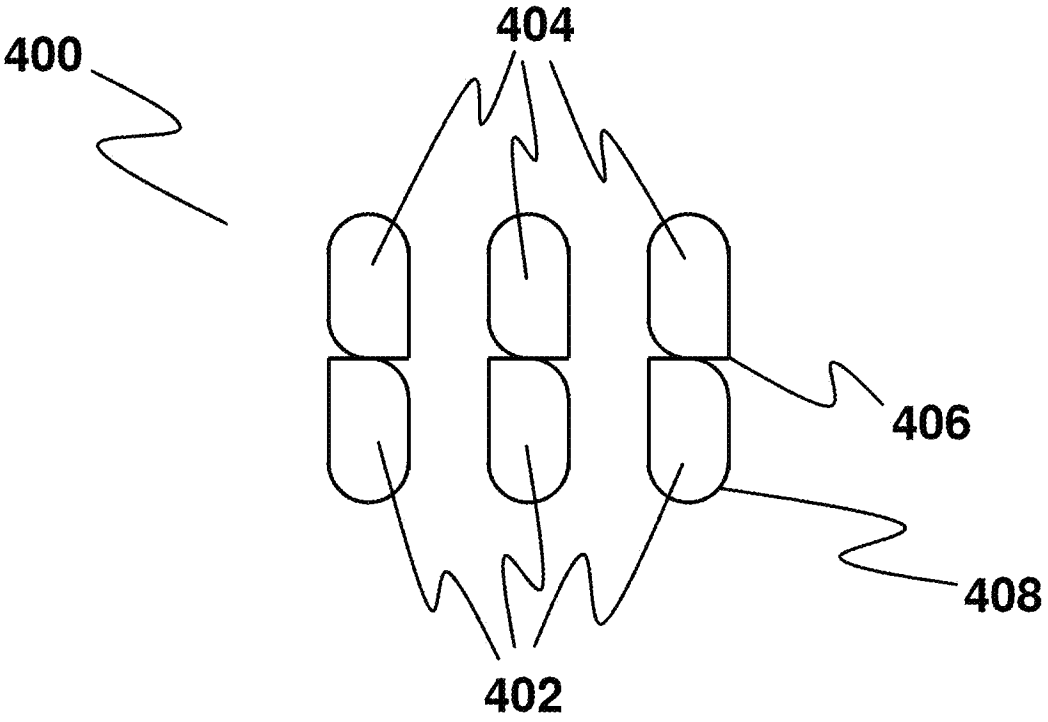
FIG. 4A is an end view of an embodiment of a cutter head having a bottom comb with teeth and cutter knives.

FIG. 4A shows an end view of an embodiment of a cutter head 400. Three cutter knives 404 and three comb teeth 402 are shown in FIG. 4A, but those skilled in the art will recognize that other numbers of cutter knives 404 and comb teeth 402 are possible. Comb teeth 402 and cutter knives 404 include substantially rounded corners 408 and substantially sharp corners 406. As shown in FIG. 4A, the upper left corner of comb teeth 402 are formed with a substantially sharp corner 406 and the other three corners of comb teeth 402 are formed with substantially rounded corners 408. As shown in FIG. 4A, the lower right corner of cutter knives 404 are formed with a substantially sharp corner 406 and the other three corners of cutter knives 404 are formed with substantially rounded corners 408. The utilization of substantially sharp corners 406 and substantially round corners 408 as shown in FIG. 4A substantially enables cutting action when cutter knives 404 are actuated to the right relative to comb teeth 402 and substantially allows friction to be applied to hair when cutter knives 404 are actuated to the left relative to comb teeth 402. Those skilled in the art will recognize that sharp corners 406 and rounded corners 408 shown in the cross-sectional view of FIG. 4A give rise to sharp edges 306 and rounded edges 308 when applied in embodiments such as the embodiment of cutter head 300 in FIG. 3 in which a perspective view is provided so that edges may be observed.

By alternating the side of the cutter knives 404 and comb teeth 402 to which substantially sharp corners 406 are applied, an embodiment of a cutter head in which cutting action is enabled when cutter knives 404 are actuated to the left and friction is enabled when cutter knives are actuated to the right is also possible. Those skilled in the art will also recognize that rotary cutter heads in which cutter knives are actuated clockwise and counterclockwise with respect to a bottom comb may also be embodied. And still further embodiments that employ cutter heads making use of cutter knives and comb teeth that do not have substantially parallel edges, vary in size as they extend to the front tip of the cutter head, vary in size or spacing, or vary in other aspects are also possible.

The view of FIG. 4A shows cutter knives 404 and comb teeth 402 with substantially rectangular cross-section. Those skilled in the art will recognize that cutter knives 404 and comb teeth 402 may comprise various cross-sections that are substantially square, trapezoidal, triangular, oval, round, hexagonal, or other possible shapes. The cross-sectional shape of cutter knives 404 and comb teeth 402 may also change along their length so that the cross-sectional shape of cutter knives 404 and comb teeth 402 may change if, for example, a cross-section is viewed along a reference line taken closer to or further from the front tip 314 of the cutter knives 304 and comb teeth 302 shown in FIG. 3. Those skilled in the art will recognize that substantially rounded corners 408 may be replaced with chamfered corners, non-uniformly rounded corners, dulled corners, or other possible forms or finishes of corners that would achieve the desired effect to allow a cutter head utilizing them to allow hair to be collected and to apply friction instead of cutting action in some modes of operation. Further, it is also possible to use different shapes and/or finishes on the various locations where substantially rounded corners 408 are applied. For example, embodiments are possible in which substantially rounded corners 408 applied to the tops of cutter knives 404 are of a different shape from the substantially rounded corners 408 applied to the bottoms of the comb teeth 402. Those skilled in the art will also recognize that substantially sharp corners 406 may be replaced with serrated edges, sharp corners that are not formed as a square edge, sharp beveled edges (see FIG. 4D for an example of a beveled edge), or other possible forms or finishes of corners that would achieve the desired effect to allow a cutter head using them to provide cutting action when actuated appropriately. Embodiments are also possible in which substantially sharp corners 406 applied to cutter knives 404 are of a different form, shape, finish or are otherwise different from substantially sharp corners 406 applied to comb teeth 402. Those skilled in the art will recognize that a wide variety of configurations of substantially sharp corners 406 may be combined with a wide variety of configurations of substantially rounded corners 408 to generate a very wide array of possible embodiments of cutter head 400.

Figure 4B:
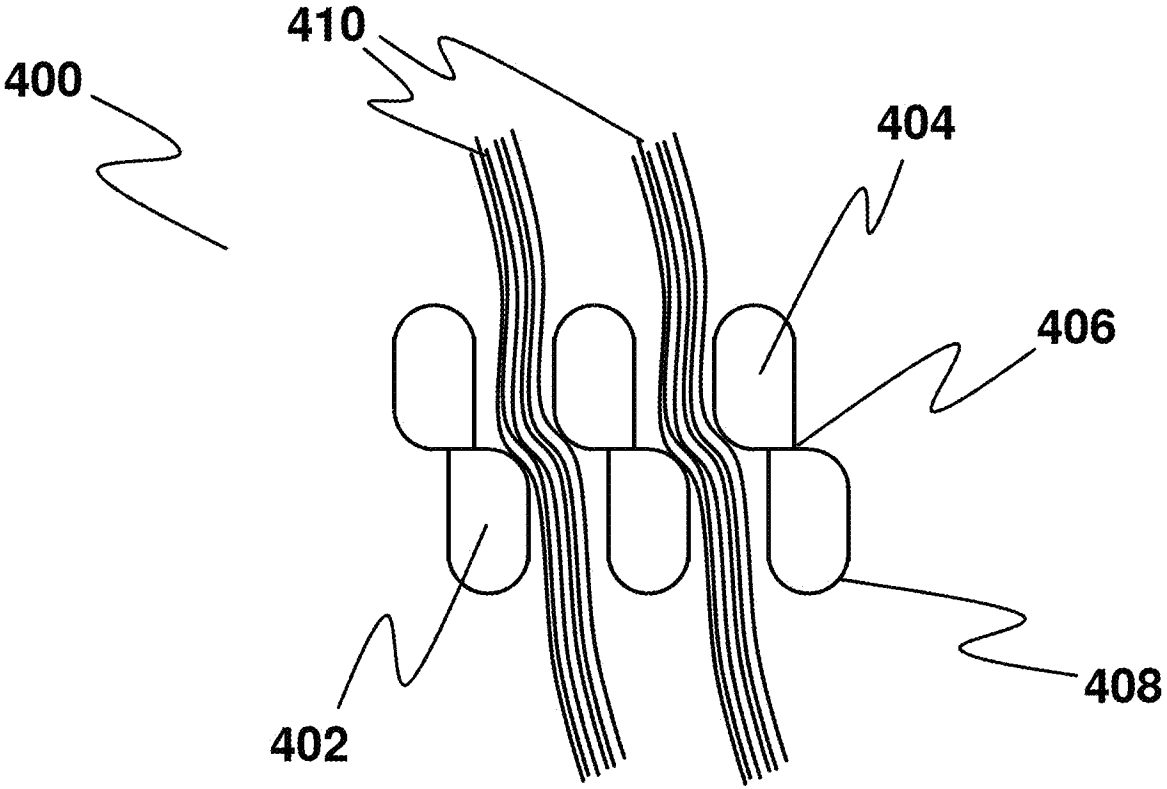
FIG. 4B is another view of the cutter head shown in FIG. 4A, wherein the cutter knives are shown actuated in a leftward direction.
Figure 4C:
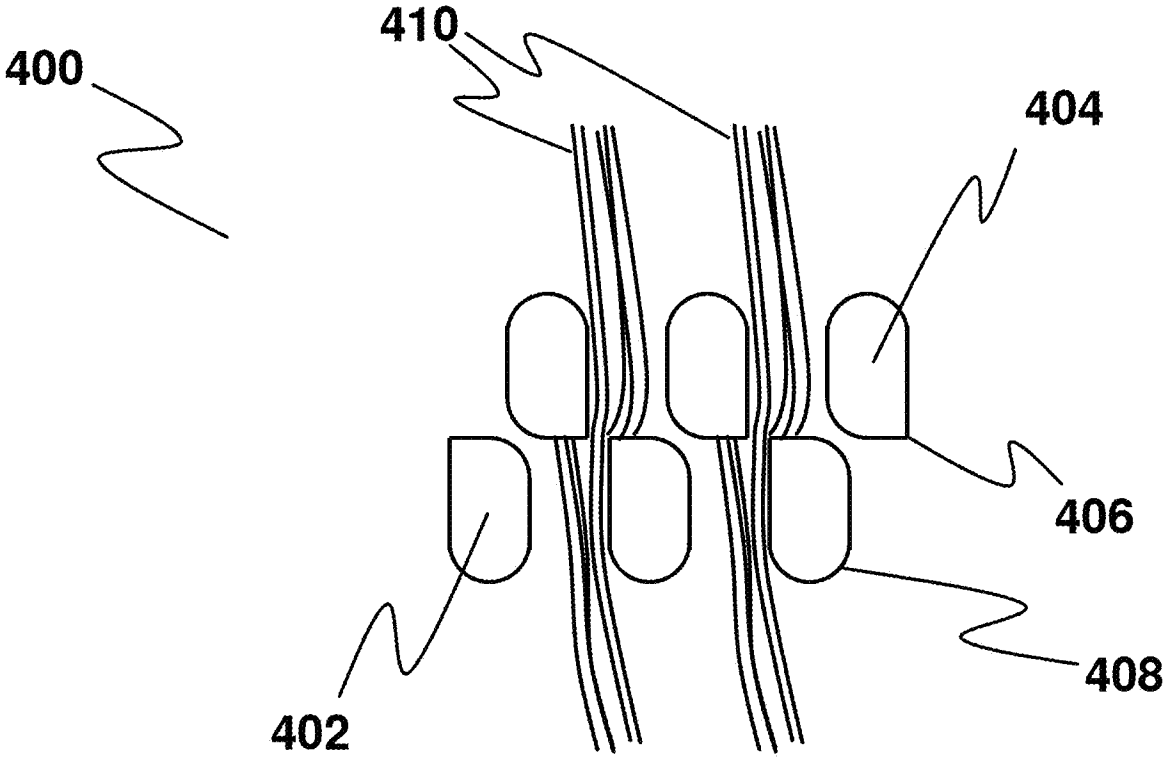
FIG. 4C is yet another view of the cutter head of FIG. 4A, wherein the cutter knives are shown actuated in a rightward direction.

FIG. 4A shows cutter head 400 positioned so that cutter knives 404 are positioned directly above comb teeth 402. In this position, the space between adjacent cutter knives 404 and adjacent comb teeth 402 is substantially maximized so that hair may be collected substantially easily. While hair being collected in cutter head 400, with cutter knives 404 positioned as shown in FIG. 4A, may touch sharp corners 406, contact between hair and sharp corners 406 is substantially minimized as the action of comb teeth 402 and cutter knives 404 serves to push most of the hair that may be collected substantially away from sharp corners 406. FIG. 4B shows a view of cutter head 400 in which cutter knives 404 are actuated to the left relative to comb teeth 402 so that the lateral spacing of cutter knives 404 and comb teeth 402 is reduced and so that hair 410 shown may be partially gripped as shown so that friction may be applied to hair 410. FIG. 4C shows a view of cutter head 400 in which cutter knives 404 are actuated to the right relative to comb teeth 402 so that hair 410 shown may be partially cut as shown. If cutter knives 404 as shown in FIG. 4C were further actuated to the right relative to comb teeth 402, hair 410 would be substantially fully cut.

Certain embodiments of cutter head 400 may benefit if cutter knives 404 are substantially accurately actuated relative to comb teeth 402. Actuation and control of cutter knives 404 relative to comb teeth may be achieved by various methods of actuation, control, measurement, alignment, sensing, suspension, and other system methods and elements available in the art. Actuation and control systems that utilize magnetic actuators, magnetic motors, piezo actuators, piezo motors, stepper motors, voice coil motors, voice coil actuators, levers, gears, belts, pulleys, slides, bearings, pivots, light sensors, encoders, magnetic sensors, inductive sensors, Hall-effect sensors, measurement of magnetic reluctance, force sensors, cameras, video cameras, uniform illumination, structured light illumination, transducers, digital control, analog control, compensators, servo systems, servo system components, or other actuation or control techniques may be applied to the control of cutter knives 404 relative to comb teeth 402. With regard to the cutter head with bottom comb 240 shown in FIG. 2B, it is possible to actuate cutter knives 404 individually, in groups, or all together at the same times.

Additionally, while embodiments shown and described in this patent disclosure uniformly show actuation of cutter knives 404 or other cutting knives moving relative to comb teeth 402 or other embodiments of comb teeth, it is also possible to generate embodiments in which cutter knives 404 are substantially in a fixed position relative to a hair cutting device 200 and in which elements of a cutter head 202 are configured so that those elements operating substantially most closely to scalp of user 102 (such as comb teeth 402) are actuated and move to provide desired actions (such as controlling position, applying friction, adjusting spacing, or providing cutting action). Such alternate embodiments may be beneficially combined with controls of cutter head 202 through automated hair cutting system 100 so that actuation of those elements of a cutter head 202 substantially most close to scalp of user 102 are substantially not actuated when cutter head 202 is in contact with the scalp of user 102. Those skilled in the art will recognize from review of this patent disclosure that such embodiments are possible. Further, certain embodiments in which both cutter knives 404 and comb teeth 402 are actuated so that both may move relative to hair cutting device 200 are also possible.

Some embodiments of control systems designed to control cutter knives 404 relative to comb teeth 402 may benefit from control objectives specific to the operating modes of a cutter head incorporating a cutter head such as cutter head 400. A control objective with cutter knives 404 directly above comb teeth 402, as shown in FIG. 4A, (or adjusting cutter knives 404 to other beneficial positions relative to comb teeth 402) may be accurate location of cutter knives 404 directly above comb teeth 402; and such an objective may be achieved with a control loop and position sensor capable of sensing this specific condition. A control objective with cutter knives 404 applying friction to hair 410, as shown in FIG. 4B, may be controlled force (and so, controlled friction) applied to hair 410; and such an objective may be achieved with a substantially constant force control such as would be substantially achieved with substantially constant current through an electromagnetic actuator (such as a voice coil motor). And, a control objective with cutter knives 404 actuated for cutting, as shown in FIG. 4C, may be rapid acceleration and strong force to ensure hair 410 is cut; and such an objective may be achieved with maximum applied force (such as would be achieved with substantially maximum current through a voice coil motor) possibly with motion limited by a mechanical crash stop. Additional force to ensure hair 410 is cut may be obtained in some embodiments by first driving cutter knives 404 to the left so that hair 410 is compressed without cutting it, and then releasing cutter knives 404 so that they spring back to the right. In this way, additional force and acceleration may be added with an actuator or motor to the rebounding cutter knives 404 in the direction to the right so that higher levels of speed and force may be achieved for cutting hair 410.

It is further noted that some embodiments of cutter head 400 and other possible cutter heads may benefit at times from the application of vibration. For some types of hair, it may aid smooth and controlled flow of hair to apply vibration. Vibration may be applied in the view shown in FIG. 4B by momentarily driving the cutter knives 404 to the left and then relaxing the force applied to them. Alternatively, the cutter knives 404 may be actuated back and forth (at reduced amplitudes so that hair 410 is not cut when it should not be) to generate vibration. Vibration could alternatively be provided through other techniques such as using a vibration actuator, vibration motor, or other techniques as are commonly used in cell phones, massagers, or other appliances that vibrate. Hair may also be treated with water, oils, gels, powders, or other materials to facilitate smooth flow through any of the wide range of possible cutter heads that may or may not provide vibration, controlled friction, or other techniques to facilitate the smooth flow of hair.

Automated hair cutting system 100 may be used to measure the length of hair of a user 102. Referring again to FIG. 4B, accordingly, if cutter knives 404 are actuated to the left relative to comb teeth 408 so that friction is applied to hair 410, and if cutter head 400 is extended away from a user's 102 head after hair 410 has been collected in cutter head 400, that as hair 410 slips through cutter head 400 as the length of hair 410 is exceeded as cutter head 400 is extended; that cutter knives 404 may move somewhat further to the left as the force applied to hair 410 is no longer acting on hair 410 once it slips through cutter head 400. Those skilled in the art will recognize that, for such a condition, a sensing and control system sensing the position of cutter knives 404 relative to comb teeth 408 may provide an indication that cutter knives 404 have moved further to the left and in so doing, provide a signal that hair 410 has slipped from cutter head 400, so further indicating that the length of hair 410 was exceeded, and so providing an indication of the length of hair 410.

Figure 4D:
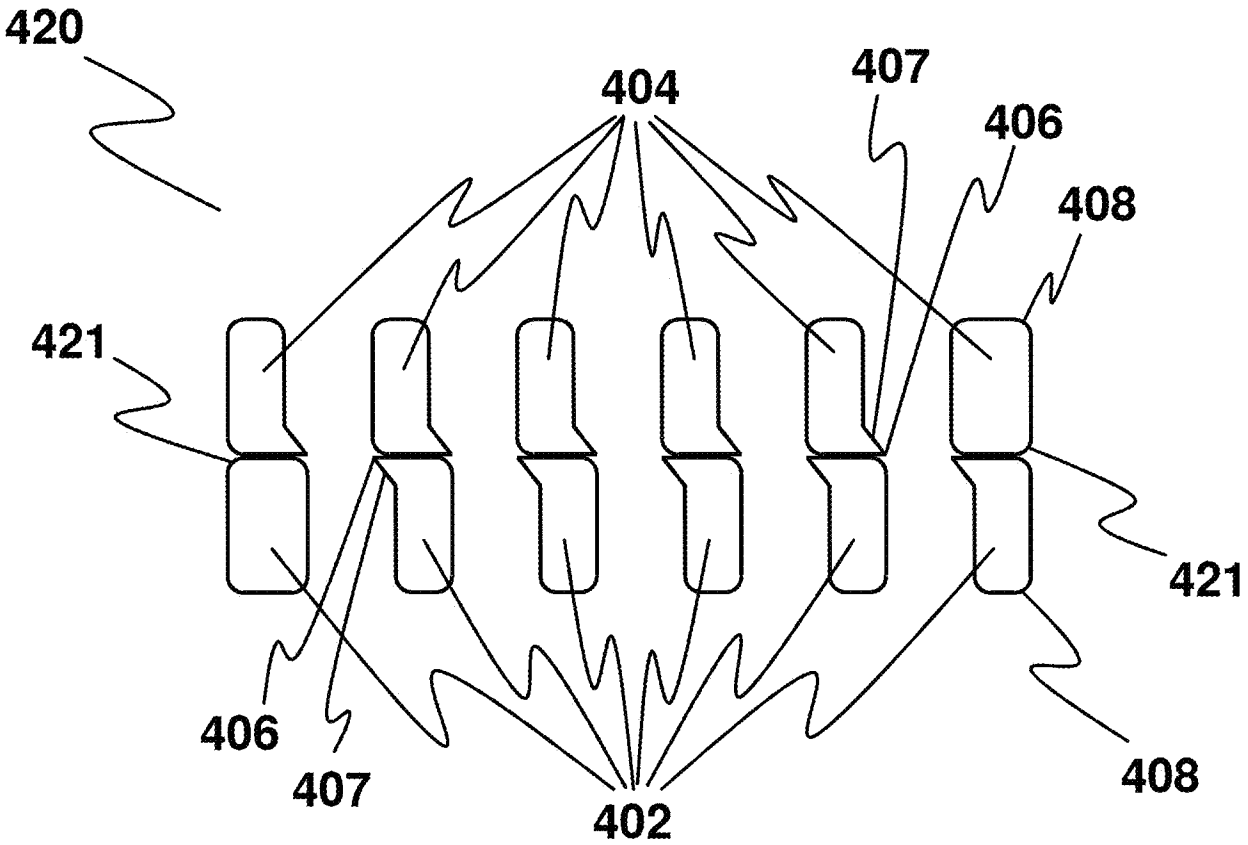
FIG. 4D is an end view of another embodiment of a cutter head according to the present disclosure wherein a right end cutter knife and left end comb tooth have a rounded edge for improved safety and protection for exposure to one or more sharp edges.

FIG. 4D shows a cross-section view of an embodiment of a cutter head with rounded end knives 420. Six cutter knives 404 and six comb teeth 402 are shown in FIG. 4D, but those skilled in the art will recognize that other numbers of cutter knives 404 and comb teeth 402 are possible. Sharp corners 406 in FIG. 4D are formed on bevels 407, demonstrating an embodiment in which beveled edges are included on cutter knives 404 and comb teeth 402. Rounded corners 408 are shown in the embodiment on all corners of cutter knives 404 and comb teeth 402 that do not have bevels 407 and sharp corners 406. In the embodiment of cutter head with rounded end knives 420 shown in FIG. 4D, the right-most cutter knife 404 and the left-most comb tooth 402 have an additional rounded corner 421 in place of the bevels 407 and substantially sharp corner 406 utilized on all the other cutter knives 404 and comb teeth 402. Additional rounded corners 421 are rounded instead of sharp as these otherwise sharp corners may never be actually used for cutting in the course of actuation of a cutter head (see FIG. 3 and FIG. 4A through 4C and the associated descriptions for reference) and, as they are on the ends of the cutter head, they would be exposed at times in the course of cutter head actuation. Hence, additional rounded corners 421 may be included as a matter of safety to avoid unnecessarily exposed substantially sharp corners 406 at the ends of a cutter head.

In FIG. 4D, additional rounded corners 421 are shown with uniform circular rounding. However, embodiments are possible in which alternative rounding may be desired at the ends of a cutter head, so embodiments are possible in which additional rounded corners 421 have a different shape than substantially rounded corners 408 used in other locations. For example, additional rounded corners 421 may be chamfered, dulled, have elliptical shape, or otherwise differ from substantially rounded corners 408. Embodiments are also possible in which the right-most cutter knife 404 and/or the left-most comb tooth 402 are made from different materials from the other cutter knives 404 and comb teeth 402 as they are not required to cut hair. For example, the right-most cutter knife 404 and/or the left-most comb tooth 402 may be fabricated from plastics, rubber, have rubber coatings, or otherwise be fabricated from materials or combinations of materials to make them safer as they are exposed in the course of actuation of cutter head with rounded end knives 420. Embodiments are also possible in which right-most cutter knife 404 as shown in FIG. 4D is actuated independently from other cutter knives 404 and may not be actuated as far or may be actuated more slowly, or may be otherwise actuated to improve safety. Embodiments are also possible in which right-most cutter knife 404 as shown in FIG. 4D is not actuated, but is made from compliant material or is mounted or suspended in such a fashion that actuation of the other cutter knives 404 shown in FIG. 4D push it slightly out of the way, as may be beneficial to complete a cutting stroke, in the course of actuation of cutter head with rounded end knives 420.

Figure 4E:
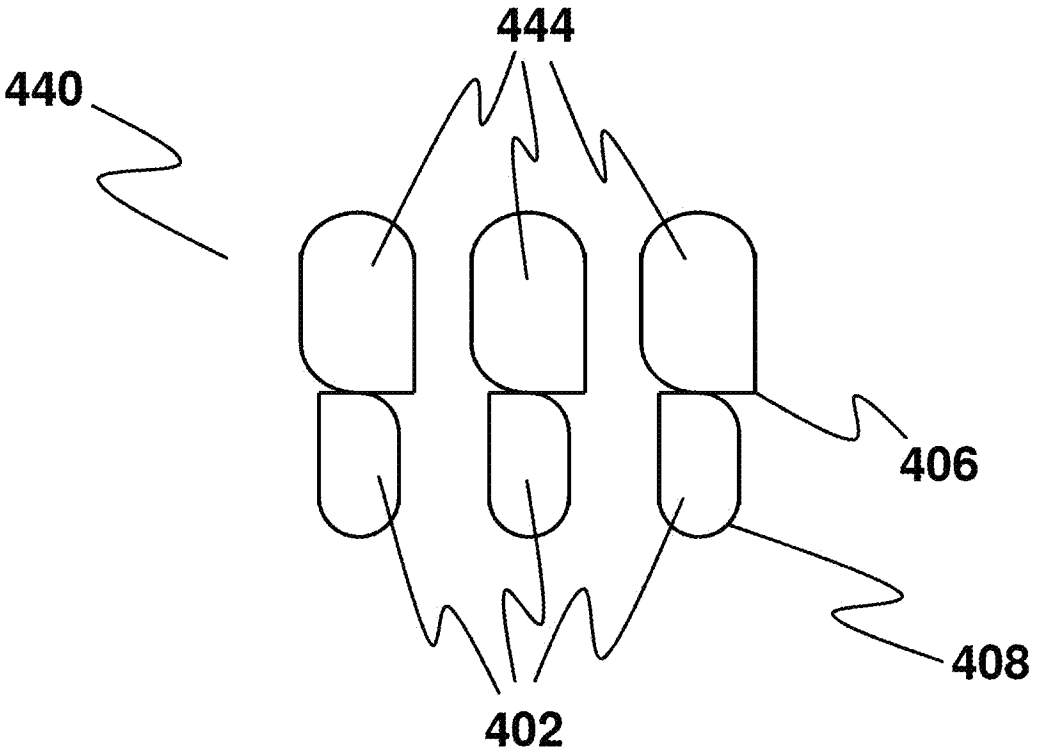
FIG. 4E is an end view of yet another embodiment of a cutter head having at least a plurality of cutter knives and bottom comb teeth according to the present disclosure.

FIG. 4E shows a cross-section view of an embodiment of a cutter head with enlarged cutter knives 440. The embodiment of FIG. 4E operates similar to cutter head 400 shown in FIG. 4A through 4C. However, enlarged cutter knives 444 are enlarged relative to comb teeth 402. Substantially sharp corners 406 and substantially rounded corners 408 are also shown in FIG. 4E and perform identical functions to those shown in FIG. 4A through 4C. Since the vertical thickness of comb teeth 402 may limit the shortest possible length that hair may be cut to, and since hair may be tangled and at times hard to comb through a cutter head, embodiments in which enlarged cutter knives 444 are utilized may be beneficial in providing sufficient strength to allow hair to be combed through a cutter head without damaging or excessively bending the cutter head. Enlarged cutter knives 444 are shown both thicker and wider in FIG. 4E than comb teeth 402, but embodiments are possible in which enlarged cutter knives are made only thicker or wider than comb teeth 402. Of course embodiments in which cutter knives 404 are made thinner or narrower than comb teeth 402 are also possible.

Figure 4F:
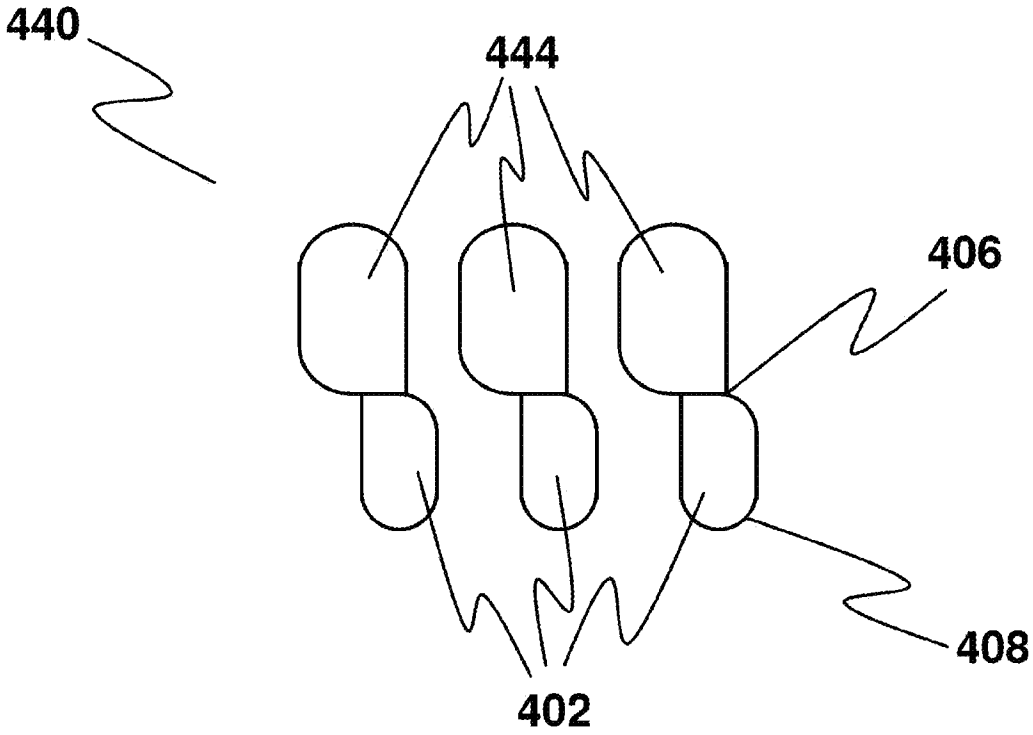
FIG. 4F is another view of the cutter head shown in FIG. 4E wherein the cutter knives are shown actuated leftward.

FIG. 4F shows the embodiment of cutter head with enlarged cutter knives 440 shown in FIG. 4E, but with enlarged cutter knives 444 actuated somewhat to the left relative to comb teeth 402. In fact, enlarged cutter knives 444 are shown actuated relative to comb teeth 402 just to the point that substantially sharp corners 406 of enlarged cutter knives 444 meet the surface of comb teeth 402 so that an inside corner is formed. In this way, hair engaged in a cutter head actuated as shown in FIG. 4F would substantially not be able to contact sharp corners 406 of either enlarged cutter knives 444 or comb teeth 402. It is clear that actuation to such a condition is also possible for the embodiments shown in FIGS. 4A-4D of cutter head 400 and cutter head with rounded end knives 420. It will be clear to those skilled in the art that utilization of an actuated condition of cutter knives 404, enlarged cutter knives 444, or other possible cutter knives relative to comb teeth so that hair may smoothly flow over them without substantially contacting substantially sharp corners 406 may be beneficial for collecting hair in cutter heads of some possible cutter head embodiments.

Figure 5:
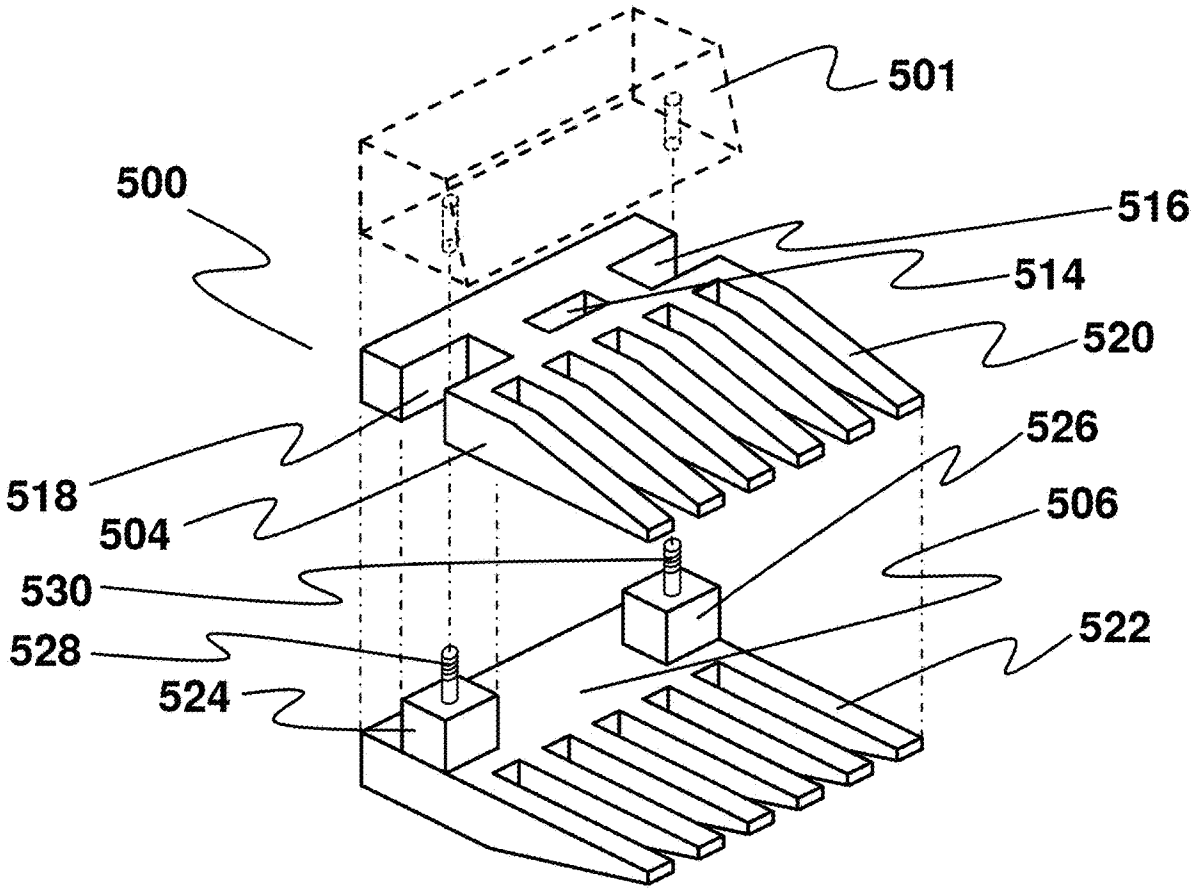
FIG. 5 is an exploded view of yet another embodiment of a cutter head according to the present disclosure, having at least a top cutter, a bottom comb, and a housing.

In FIG. 5, a cutter head 500 is shown in an exploded view so that various elements may be shown in detail. FIG. 5 includes bottom comb 506 and top cutter 504 that may be actuated back and forth relative to each other by an actuator, motor, or other mechanism to achieve hair cutting action similar to that explained in FIG. 3 for cutter head 300 and for other embodiments of cutter heads in this patent disclosure. In an actual assembled cutter head 500, bottom comb 506 and top cutter 504 would contact each other, mating together as shown by the dashed lines in FIG. 5 so that cutter knives 520 of top cutter 504 mate with comb teeth 522 of bottom comb 506; left mounting standoff 524 would mate to top cutter 504 through left guide opening 518 and right mounting standoff 526 would mate to top cutter 504 through right guide opening 516; left mounting screw 528 and right mounting screw 530 are shown engaging (through dashed lines) housing 501 in FIG. 5, but may engage an actuator, motor, mounting bracket, frame, or other element of a hair cutting device (such as hair cutting device 200) in various embodiments so that cutter head 500 may be mounted for beneficial operation.

Housing 501 in FIG. 5 is drawn in dashed lines as it not technically a part of cutter head 500, but rather, is an element to which cutter head 500 may be attached. Housing 501 may be a part of a hair cutting device such as hair cutting device 200. Housing 501 may contain an actuator, motor, or other mechanism that may couple to top cutter slot 514 and may actuate top cutter 504. Housing 501 may also contain sensors and other elements beneficial in sensing and controlling cutter head 500. Left mounting screw 528 and right mounting screw 530 extend upward through bottom comb 506 and left mounting standoff 524 and right mounting standoff 526, respectively. Left mounting screw 528 and right mounting screw 530 may be similar to commonly available machine screws or other suitable screws and may be secured with a commonly available screw driver from below bottom comb 506. Those skilled in the art will recognize that many alternative fasteners such as bolts, rivets, clips, latches, cams, welds, adhesives, or other fastening techniques may be used in some embodiments in place of left mounting screw 528 and right mounting screw 530.

An actuating member, lever, shaft, or other mechanism may engage top cutter 504 through top cutter slot 514 and transfer motion of a linear motor, actuator, or other mechanism through top cutter slot 514 to actuate top cutter 504 relative to bottom comb 506 (those skilled in the art will recognize that alternative ways to contact top cutter 504 instead of using top cutter slot 514 are possible, attachments may include bolts, screws, welds, rivets, or other possible connections). Left guide opening 518 and right guide opening 516 slide over the surfaces of left mounting standoff 524 and right mounting standoff 526, respectively, so that a substantially smooth and guided actuation of cutter knives 520 relative to comb teeth 522 may be achieved. Those skilled in the art will recognize that the embodiment of FIG. 5 utilizing mounting standoffs and guide openings to control and guide motion of top cutter 504 is only one of many possible embodiments. Additional embodiments that make use of sliding rectangular channels, sliding dovetailed channels, sliding channels of various cross-sectional shapes, roller bearings, levers, gears, and other possible elements to provide guided motion in response to actuation are also possible.

Cutter knives 520 and comb teeth 522 shown in FIG. 5 have squared and sharp edges on both sides so that cutting action may be achieved when they are actuated in either direction. However, embodiments in which cutter knives and comb teeth such as those shown in FIG. 3 that provide cutting action in one direction of actuation and friction to hair when actuated in another direction are also possible.

Top cutter 504 and bottom comb 506 are shown in FIG. 5 with substantially flat, rigid, and planar mating surfaces. However, those skilled in the art will recognize that some embodiments may benefit from substantially thinner top cutters and/or bottom combs and that, for some such embodiments, use of top cutters and/or bottom combs that have mating surfaces that are substantially somewhat concave or convex may be beneficial so that compressive pressure from left mounting screw 528, right mounting screw 530, actuator housing 510, or other elements as may be found in various embodiments may be distributed across the mating surfaces of top cutters and bottom combs so that substantially more intimate contact may occur. Those skilled in the art will recognize that some cutting tools such as scissors commonly make use of concave mating surfaces between cutting elements so that intimate contact of cutting edges is established and maintained through the course of a cutting cycle. Hence, the use of specially formed or shaped top cutters and bottom combs using concave mating surfaces, convex mating surfaces, or other shapes or types of mating surfaces for various embodiments is possible.

Figure 6:
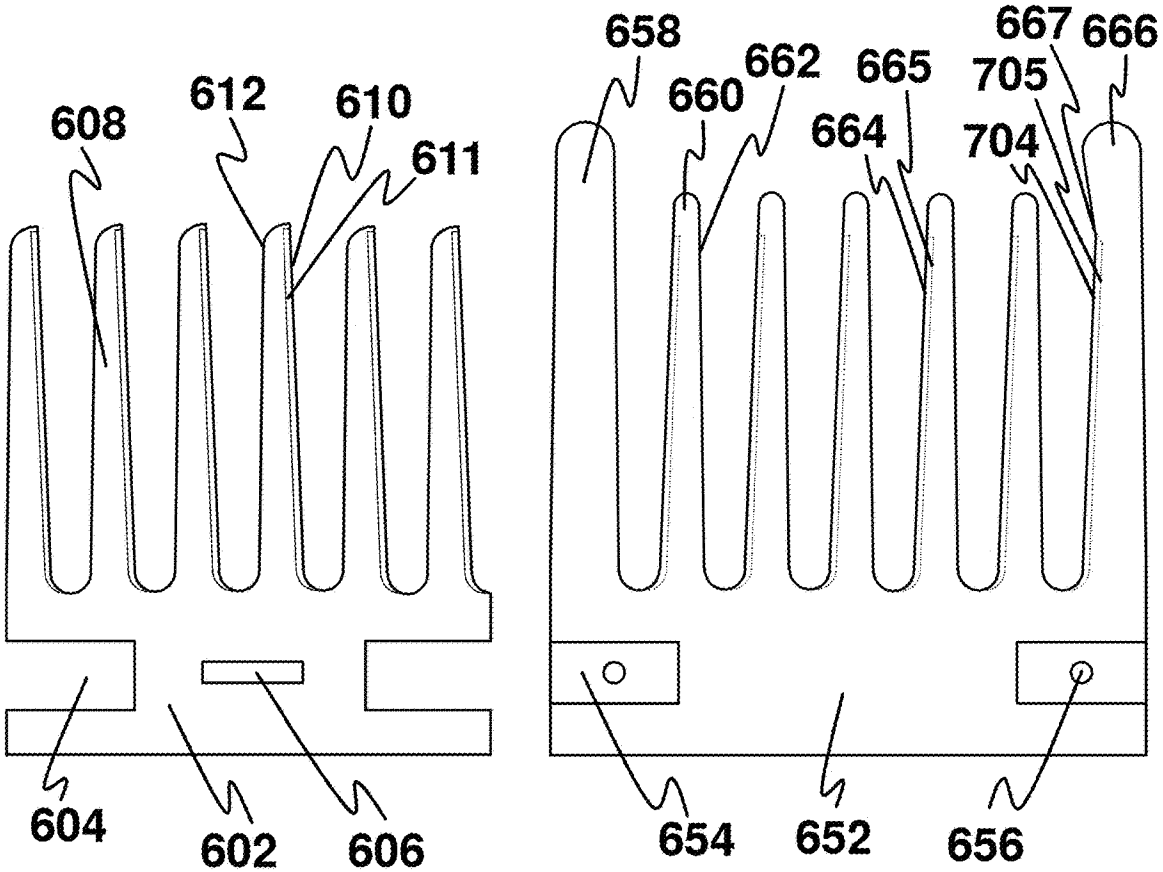
FIG. 6 is a top view of components of a cutter head, a top cutter and a bottom comb, according to the present disclosure.

FIG. 6 shows an embodiment of a top cutter 602 and a bottom comb 652. Top cutter 602 may be placed on top of bottom comb 652 to create a cutter head in a fashion similar to cutter head 500 of FIG. 5, but providing beneficial operation due to the unique and novel features of top cutter 602 and bottom comb 652. Top cutter 602 includes six cutter knives 608 each having back edge 612 and sharp edge 610. Top cutter 602 in FIG. 6 includes six cutter knives 608, but those skilled in the art will recognize that top cutters 602 with different numbers of cutter knives are possible. Top cutter 602 also includes guide openings 604 and top cutter slot 606. Bottom comb 652 shown in FIG. 6 includes five comb teeth 660, left end comb tooth 658, right end comb tooth 666, mounting standoffs 654, and screw holes 656. Each comb tooth 660 includes a back edge 662, and a sharp edge 664. Right end comb tooth 666 also has a sharp edge 704 along its left side. In the embodiment of FIG. 6, bottom comb 652 has sharp edges 664 and sharp edge 704 that do not extend all the way to the tips of comb teeth 660 and right end comb tooth 666. Rather, sharp edges 664 and sharp edge 704 only extend so far as needed so that sharp edges 610 of cutter knives 608 may contact them substantially through a full cutting stroke as will be explained subsequently. Those skilled in the art will recognize that while bottom comb 652 has five comb teeth 660 to operate effectively with top cutter 602 as shown in FIG. 6, embodiments that include additions or subtractions of cutter knives 608 in top cutter 602 may lead to corresponding additions or subtractions of comb teeth 660 in bottom comb 652.

As noted above, each cutter knife 608 has a sharp edge 610. The embodiment of FIG. 6 shows a bevel that begins along a bevel line 611 offset from sharp edge 610. Whatever material is used for an embodiment of top cutter 602 may be machined, ground, sharpened, or otherwise formed to create a bevel starting from bevel line 611 and extending down to a substantially sharp edge 610. Those skilled in the art will recognize that formation of such a bevel is very common for many sharpened tools including common scissors, knives, cutters, and other sharpened tools. Those skilled in the art will also recognize that embodiments are possible in which multiple bevels or other contours are utilized to form a sharp edge and that a bevel line 611 may or may not be readily visible for all possible embodiments. Similarly, for bottom comb 652, comb teeth 660 and right end comb tooth 666 have bevels formed beginning at bevel lines 665 and bevel line 705, respectively; and extending to sharp edges 664 and sharp edge 704, respectively. Bevel lines 665 and bevel line 705, in FIG. 6, are shown with dotted lines as the bevels on bottom comb 652 are formed on the side of bottom comb 652 not visible in FIG. 6. Embodiments are also possible in which sharp edges 610, sharp edges 664, and sharp edge 704 are formed without bevels.

Sharp edges 610, sharp edges 664, and sharp edge 704 in the embodiment of FIG. 6 are shown as straight and substantially smooth sharp edges. Additional embodiments may make use of serrated, contoured, wavy, or other configurations of edges. Combinations of edge types, for example using a straight smooth edge for sharp edges 610 on cutter knives 608 and serrated edges for sharp edges 664 and sharp edge 704 on bottom comb 652, are also possible.

In the embodiment of FIG. 6 that sharp edges 610 on cutter knives 608 extends almost, but not completely to the tip of cutter knives 608. It is also noted that sharp edges 664 and sharp edge 704 of bottom comb 652 don't extend fully to the tips of the comb teeth they are formed on. Embodiments in which sharp edges 610 extend all the way to the tip of cutter knives 608 are possible. Variable lengths of sharp edges 664 and sharp edge 704 are also possible and may be of substantially identical length to sharp edges 610 on cutter knives 608 or may be longer or shorter in some embodiments. Depending on the materials used and the many possible variables in the size and shape of cutter knives 608 and comb teeth 660, various embodiments for the lengths and configurations of sharp edges in cutter heads are possible.

Bottom comb 652 in FIG. 6 has inflection 667 on right end comb tooth 666. Inflection 667 may be present in some embodiments so that regularly spaced and substantially identical cutter knives 608 may be utilized on top cutter 602 and so that the amount of hair substantially collected for cutting by each cutter knife 608 is substantially similar. This is achieved by laterally spacing right end comb tooth 666 so that its tip is laterally spaced from the adjacent comb tooth 660 tip substantially equally to the spacing of other comb teeth 660 tips. Those skilled in the art will recognize that many alternative shapes for comb teeth 660, right end comb tooth 666, left end comb tooth 658, and cutter knives 608 are possible. And embodiments are possible that use irregularly spaced or shaped cutter knives 608 and comb teeth 660. Hence, the embodiment of FIG. 6 and the use of inflection 667 is only one of many possible embodiments.

Figure 7A:
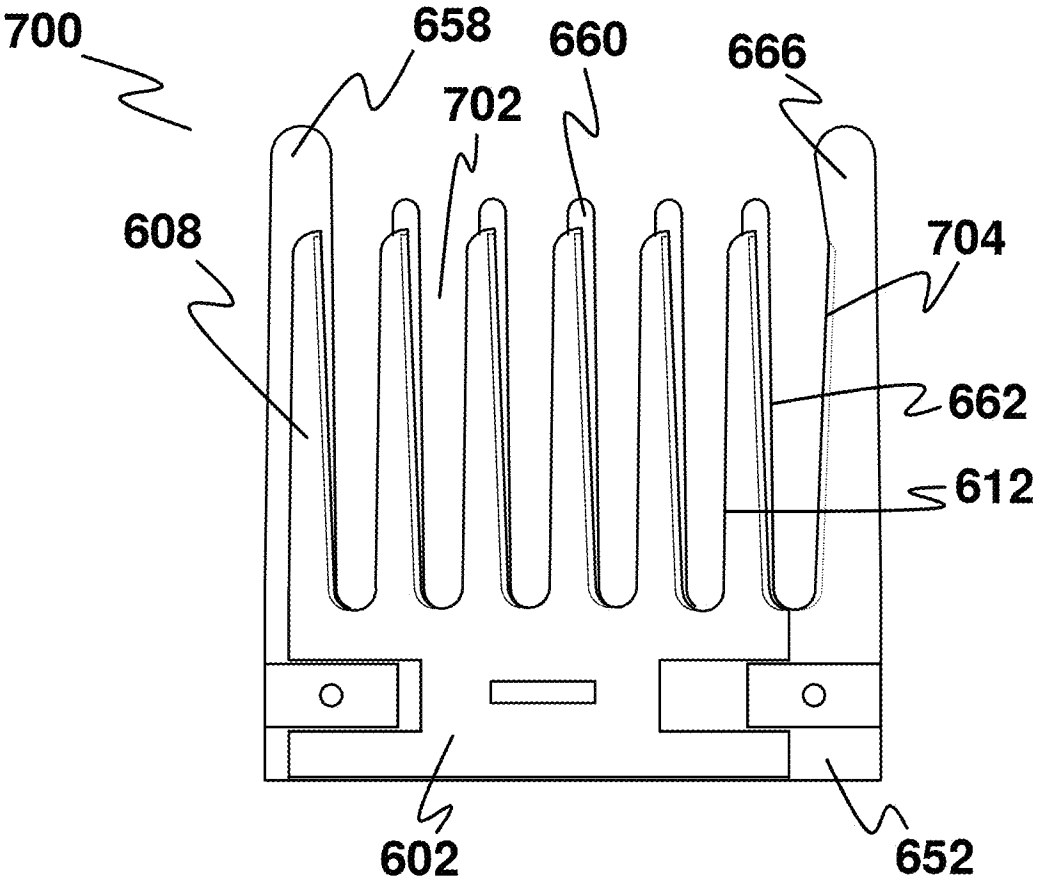
FIG. 7A is another view of the components shown in FIG. 6, shown in a first position, wherein the top cutter is placed on top of the bottom comb.

Referring to FIG. 7A, top cutter 602 may be placed on top of bottom comb 652 with guide openings 604 mating to mounting standoffs 654 so that cutter head 700 may be formed. Cutter head 700 is formed in a similar fashion to cutter head 500 of FIG. 5 although top cutter 602 and bottom comb 652 may have novel and beneficial shapes and construction for some embodiments versus top cutter 504 and bottom comb 506 shown in FIG. 5. Top cutter 602 has sharp edges 610 and bottom comb 652 has sharp edges 664 that function in the manner of sharp corners 406 as shown and described with regard to FIG. 4A through 4F and sharp edges 306 as shown and described with regard to FIG. 3. Top cutter 602 has back edges 612 and bottom comb 652 has back edges 662 that function in the manner of rounded corners 408 as shown and described with regard to FIG. 4A through 4F and rounded edges 308 as shown and described with regard to FIG. 3. That is, back edges 612 and back edges 662 may include rounded or otherwise finished corners so that they are suitable for applying pressure and friction to hair. Referring to FIG. 7A, when top cutter 602 is actuated to the left relative to bottom comb 652 friction may be applied to hair gathered in cutter head 700 as back edges 612 and back edges 662 may appropriately compress hair between them and allow substantially smooth but somewhat restricted motion of hair through cutter head 700. Similarly, when top cutter 602 is actuated to the right relative to bottom comb 652, hair in cutter head 700 may be cut as sharp edges 610 meet sharp edges 664 (the view in FIG. 7A is such that sharp edges 664 are not visible and sharp edges 610 are not numbered in FIG. 7A to avoid cluttering the figure, the view of cutter head 700 in FIG. 7C shows sharp edges 610 and sharp edges 664 and explains a cutting stroke clearly).

In FIG. 7A, cutter head 700 is shown with cutter knives 608 positioned above comb teeth 660 so that hair may be substantially easily combed into cutter head 700. In the embodiment of cutter head 700 shown in FIG. 7A, back edges 612 of cutter knives 608 are substantially parallel to back edges 662 of comb teeth 660 so that hair easily enters openings 702. In this fashion, hair may easily enter into cutter head 700 when cutter knives 608 are positioned above comb teeth 660 so that hair is collected between back edges 612 and back edges 662 so that hair comes substantially only in contact with back edges 612 and back edges 662 and that contact between hair and sharp edges is substantially minimized. It was noted previously that back edges 612 and back edges 662 may have rounded corners (in the manner of rounded corners 408 shown in cross-section in FIG. 4A through 4F). The right edge of left end comb tooth 658 may also have a rounded corner in the manner of back edges 662 so that it also provides smooth friction to hair adjacent to it in the course of operation of cutter head 700. Hence, hair may enter cutter head 700 substantially without contacting sharp edges with one exception, that is, hair in proximity to sharp edge 704 may contact it. Some embodiments of top cutter 602 may include an additional cutter knife 608 on the far right side to shield sharp edge 704 as the other cutter knives 608 shield the other sharp edges 664 of bottom comb 652 (refer to FIG. 4D and the explanation of cutter head with rounded end knives 420 for an explanation of various shapes, materials, and actuation techniques that may be applied to embodiments including such an additional cutter knife). As will be become clear, inclusion of such an additional cutter knife 608 would mean that when cutter head 700 is actuated to cut hair, this additional cutter knife 608 would extend substantially to the right of right end comb tooth 666 and could create a safety hazard. Those skilled in the art will recognize that such an additional cutter knife 608 need not have a sharp edge 610 and may have rounded corners around all of its edges, since this additional cutter knife 608 would never actually cut hair (again, refer to FIG. 4D and note application of additional rounded corners 421 as described above). However, even with rounded edges on all sides of an additional cutter knife 608 it would still extend to the right beyond right end comb tooth 666 and may create potential safety concerns in some embodiments. Of course, right end comb tooth 666 could be widened or a hair cutting device to which cutter head 700 is attached (such as hair cutting device 200) could include a shield or guard to minimize risks associated with protrusion of an additional cutter knife 608 added to the right side of top cutter 602 during a cutting stroke of cutter head 700.

Tips of comb teeth 660 may extend somewhat beyond and above the tips of cutter knives 608. Use of comb teeth 660 that are somewhat longer than cutter knives 608 as shown may be beneficial to some embodiments as it allows comb teeth 660 with rounded corners to extend beyond sharp edges 610 of cutter knives 608 and sharp edges 664 or sharp edge 704 so that a person using a hair cutting device including cutter head 700 may be less likely able to insert a finger or other body part substantially into cutter head 700 where it might be cut and/or otherwise injured. Extension of comb teeth 660 beyond the tips of cutter knives 608 may also improve the ability of cutter head 700 to gather hair. It is further noted that left end comb tooth 658 and right end comb tooth 666 extend further beyond comb teeth 660 in the embodiment of cutter head 700 shown in FIGS. 7A, 7B, and 7C. Extension of left end comb tooth 658 and right end comb tooth 666 in this fashion may provide some protection to comb teeth 660 and cutter knives 608 from damage if a hair cutting device including cutter head 700 is dropped, pushed into other objects, or otherwise mishandled. Those skilled in the art will recognize that a wide range of variations of lengths of comb teeth, including end comb teeth, are possible for a wide range of embodiments of cutter heads. Comb teeth and end comb teeth may be of the same or different lengths and may be of the same or different lengths relative to cutter knives for various embodiments.

Figure 7B:
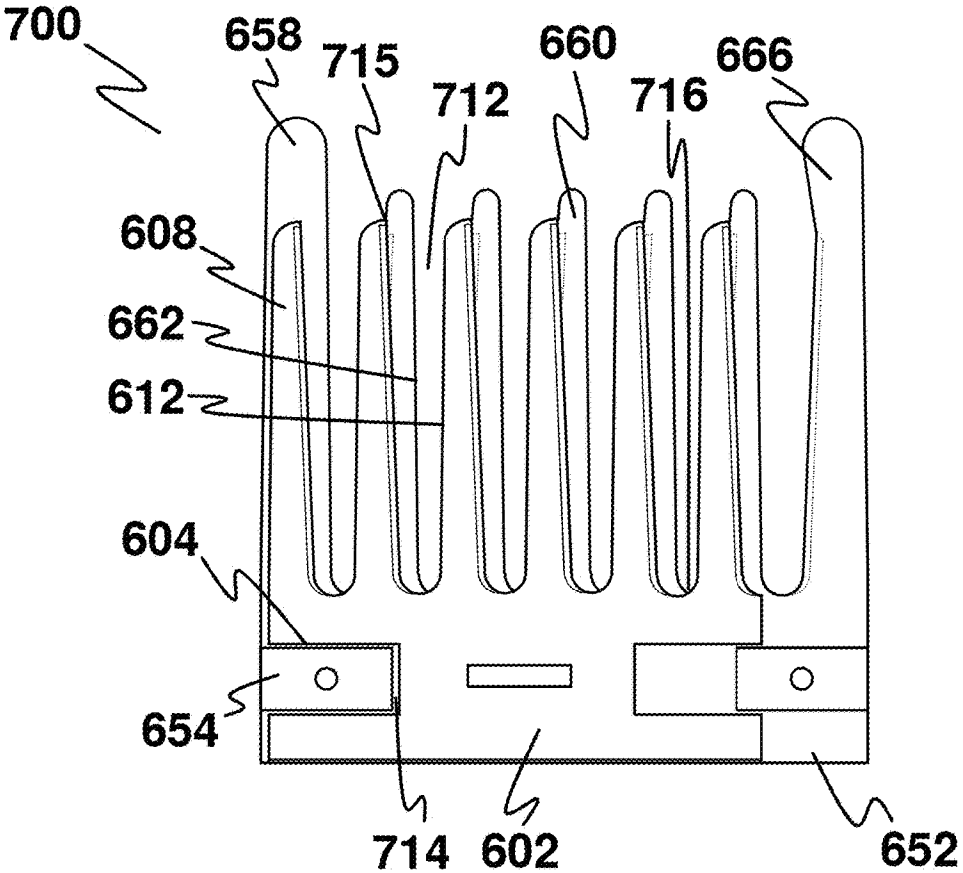
FIG. 7B is another view of the components shown in FIG. 6, shown in a second position, wherein the top cutter is positioned in a different position than FIG. 7A relative to the bottom comb.
Figure 7C:
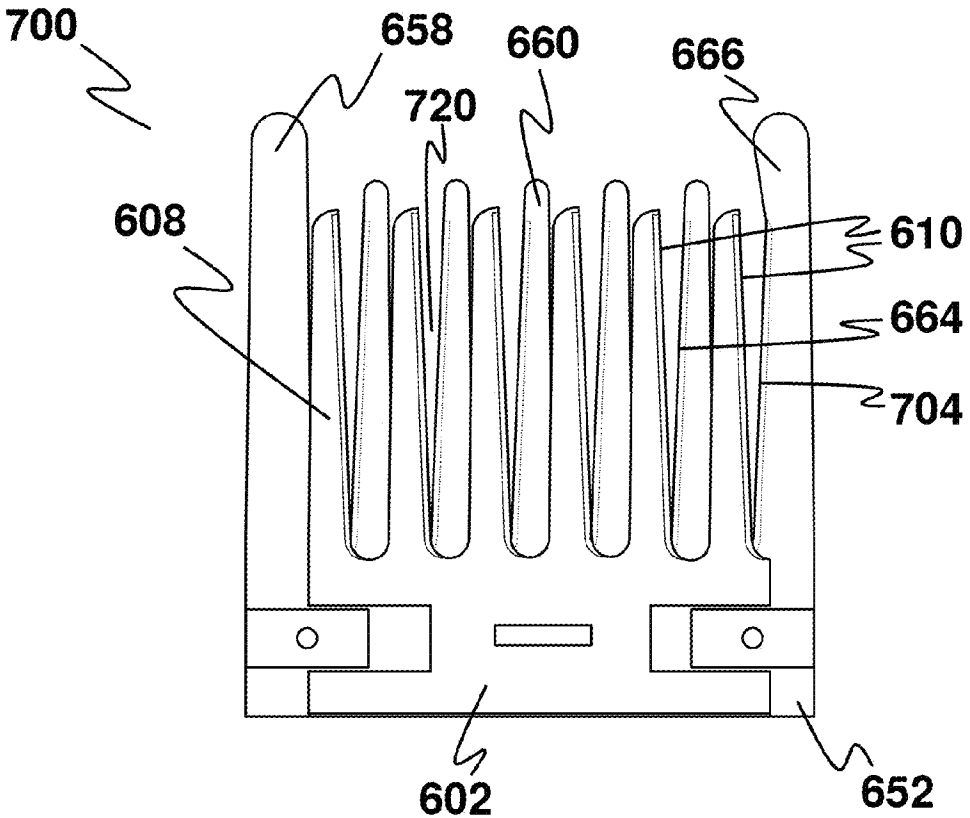
FIG. 7C is another view of the components shown in FIG. 6, shown in a third position, wherein the top cutter is positioned in a different position than FIG. 7B relative to the bottom comb.

FIG. 7B shows cutter head 700 with top cutter 602 actuated to the left relative to bottom comb 652 so that any hair in openings 712 between back edges 612 and back edges 662 may be compressed beneficially so that friction is applied to it. The embodiment of cutter head 700 provides openings 712 in which back edges 612 and back edges 662 are almost parallel and have only a slightly larger separation near the tips of comb teeth 660 than they do near the base regions 716. Openings 712 with parallel or nearly parallel back edges may provide benefit for some embodiments in providing substantially more consistent force and friction to hair distributed through openings 712. Embodiments in which back edges 612 and back edges 662 are parallel and other embodiments in which they are not parallel are clearly possible. Back edges 612 and back edges 662 may also be serrated, wavy, angled, textured, contoured, or otherwise beneficially shaped or finished in some embodiments to possibly improve ease of manipulation of hair, and/or possibly to improve distribution of hair within openings 712 as friction is applied to hair, and/or for other benefits. Rounded base regions 716 of top cutter 602 and bottom comb 652 are partially rounded and partially sharp as shown in FIGS. 6, 7A, 7B, and 7C so that as top cutter 602 is actuated to the left relative to bottom comb 652 that substantially only rounded corners in the round base regions 716 of top cutter 602 and bottom comb 652 may contact hair. Many alternatives exist for embodiments with partially or fully rounded and partially and fully sharp base regions 716 for various embodiments of top cutters 602 and bottom combs 652.

As shown in FIG. 7B, further actuation of top cutter 602 to the left relative to bottom comb 652 is not substantially possible as the gap 714 between the guide opening 604 and mounting standoff 654 is very small. However, those skilled in the art will recognize that embodiments are possible in which top cutter 602 may actuate further to the left (simply by designing guide opening 604 and mounting standoff 654 so that further actuation to the left is not blocked). For such embodiments, the tips of cutter knives 608 may move away from the edges of comb teeth 660 so that an opening with sharp edges exposed is formed at points 715 across each cutter knife 608 of cutter head 700. Exposure of sharp edges may cause hair to be damaged or to be snagged (snagging would especially be possible in the sharp triangular regions that would form between sharp edges near points 715). Hence, in the course of operation of a hair cutting device in an automated hair cutting system 100, it may be beneficial to only actuate cutter knives to generate friction against hair to the point that sharp edges are exposed when the hair cutting device is positioned so that hair is unlikely to be snagged or damaged. For example, as a hair cutting device is moved away from a person's head, at some position the cutter head may be substantially clear of loose hair and such extended actuation to generate additional friction may be undertaken with little risk of snagging loose hair. And since an automated hair cutting system 100 may have a great deal of information regarding the length of hair in a particular region of a person's head and also have information regarding the benefit of the application of additional friction to a person's hair, such an automated hair cutting system 100 may make good decisions regarding when additional friction may be best applied to the point that sharp edges in a cutter head may be exposed.

FIG. 7C shows cutter head 700 with top cutter 602 actuated partially to the right relative to bottom comb 652 so that hair between sharp edges 610 on cutter knives 608 and sharp edges 664 on comb teeth 660 or sharp edge 704 on right end comb tooth 666 may be cut. The view of FIG. 7C shows top cutter 602 positioned partially through a cutting stroke. Hair in regions 720 is between sharp edges coming together as a cutting stroke continues and is cut in the fashion of hair between the blades of a common pair of scissors. In the embodiment of cutter head 700 that sharp edges 610, sharp edges 664, and sharp edge 704 are slanted relative to each other so that a cutting point is formed where sharp edges meet and this cutting point moves toward the tips of comb teeth 660 as a cutting stroke progresses. This formation and motion of a cutting point is also analogous to operation of a common pair of scissors. Using cutter knives 608 and comb teeth 660 with slanted sharp edges that form a cutting point as shown in FIG. 7C may be beneficial as hair in regions 720 need not all be cut at the same time as a cutting stroke progresses. That is, since cutting points are formed where sharp edges meet, hair is cut through the course of a cutting stroke. Those skilled in the art will recognize that such an embodiment may reduce the peak load on an actuator driving cutter head 700 and provide smoother operation versus embodiments in which sharp edges of cutter knives and comb teeth are substantially parallel.

Figure 8A:
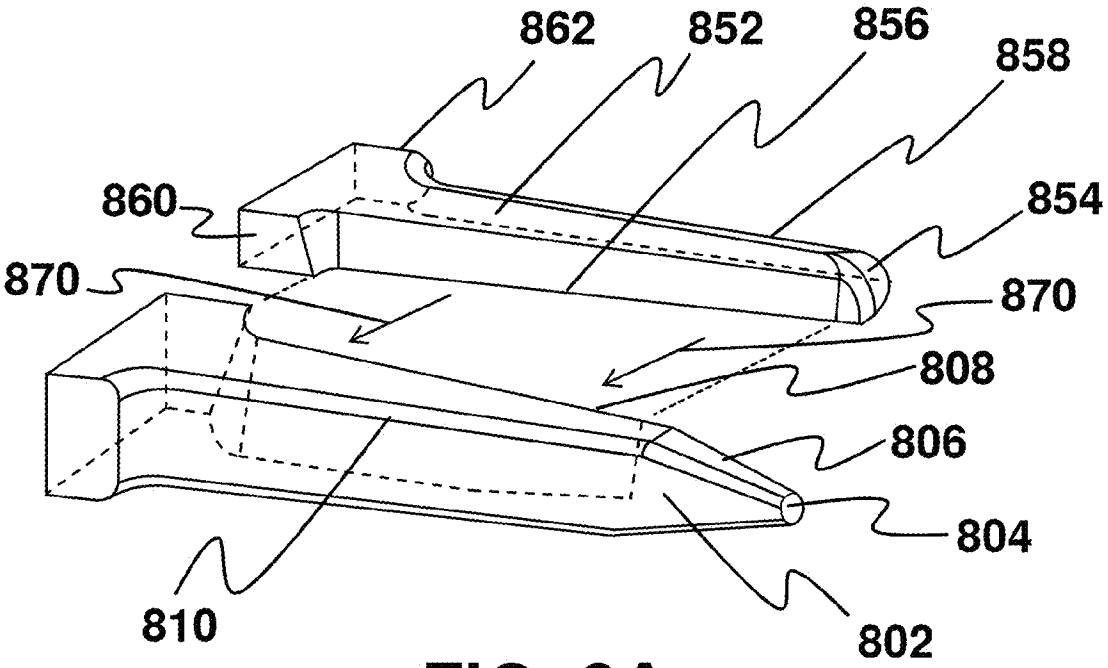
FIG. 8A is a perspective view of one embodiment of a single cutter knife and a single comb tooth according to the present disclosure.

In FIG. 8A, an embodiment of a single cutter knife 852 is shown passing over an embodiment of a single comb tooth 802. FIG. 8A is helpful to show some features of how a cutter knife 852 and comb tooth 802 may be constructed for beneficial operation. The cutter knife 852 and comb tooth 802 of FIG. 8A may be utilized in the formation of top cutters and bottom combs. Arrows 870 in FIG. 8A indicate the direction of actuation of cutter knife 852 at the beginning of a cutting stroke of a cutter head. Sharp edge 856 of cutter knife 852 will meet sharp edge 808 of comb tooth 802 so that hair between cutter knife 852 and comb tooth 802 may be cut in the course of a cutting stroke. Point 804 on comb tooth 802 may be beneficial in collecting hair and lifting hair from the scalp of a person receiving a haircut. Tapered end 806 of comb tooth 802 provides a smooth transition from point 804 to the body of comb tooth 802. Point 804 in FIG. 8A is shown as a flat ended circle, but rounded points, hemispherical points, and other points may be used on various embodiments of comb teeth 802. Back edge 810 of comb tooth 802 is shown as a smoothly rounded contour that would be suitable for applying friction to hair, but would not damage hair or provide cutting action. Similarly, back edge 858 and rounded end 854 of cutter knife 852 are also smoothly rounded and contoured to allow hair to flow smoothly over them. Sharp edge 856 and sharp edge 808 include an inclined bevel down to a sharp edge (such bevels were previously explained with regard to FIG. 6). Use of an inclined bevel in this fashion is extremely common for a wide range of common cutting tools as will be recognized by those skilled in the art. Accordingly, a very wide range of contours, bevels, points, rounded ends, and other features maybe used in the formation of cutter knives and comb teeth for cutter heads suitable for automated hair cutting systems 100. Those skilled in the art will recognize that sharp edges may include serrations, contours, faceted edges, bevels, multiple bevels, coves, and other formations. Other areas of cutter knives and comb teeth may include smooth contours, faceted forms, chamfers, and a wide range of other formations.

Formation of top cutters and bottom combs from the embodiments of cutter knife 852 and comb tooth 802, as shown in FIG. 8A may benefit from the addition of transition structures between each cutter knife 852 and comb tooth 802. For example, in the formation of a top cutter, multiple cutter knives 852 may be interspersed with transition structures so that the sharp side 860 of one cutter knife 852 may be smoothly transitioned to mate appropriately to the rounded side 862 of the next adjacent cutter knife 852 in such a top cutter so that a smoothly flowing transition from sharp to rounded edges may result. Those skilled in the art will recognize the benefit of such transition structures for the formation of both top cutters and bottom combs.

Figure 8B:
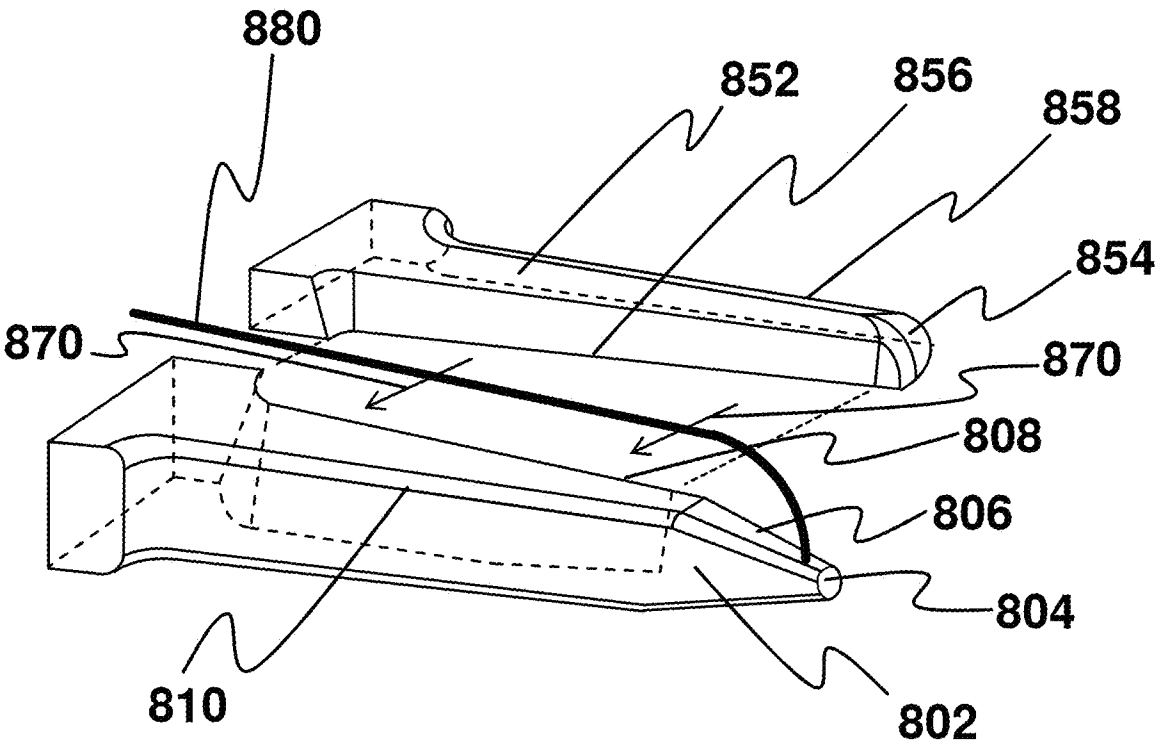
FIG. 8B is a perspective view of a comb tooth guard mounted on the comb tooth shown in FIG. 8A.

FIG. 8B includes the same cutter knife 852 and comb tooth 802 as shown in FIG. 8A. Like numbered elements in FIG. 8B have the same function as those in FIG. 8A. The embodiment of FIG. 8B further includes a comb tooth guard 880 formed from a piece of stiff wire extending from tapered end 806. Comb tooth guard 880 extends above and over comb tooth 802 and cutter knife 852 passes below comb tooth guard 880 when a cutter head containing cutter knife 852 is actuated. Comb tooth guard 880 may provide benefit in some embodiments in reducing the ability for a person to contact cutter knife 852 during use of an automated hair cutting system 100. Comb tooth guard 880 may also serve to protect cutter knife 852 and comb tooth 802 from contact with foreign objects that may damage them or compromise their operation. The free end of comb tooth guard 880, as shown in FIG. 8B, may be mounted or secured to the front surface or body of a hair cutting device (such as hair cutting device 200) or cutter head body (refer to FIG. 3 where comb tooth guard 340 is attached to body 320 with attachments 342), to the free end of other comb tooth guards, or to other possible fixtures; or in some embodiments comb tooth guard 880 may be sufficiently rigid that mounting it only to tapered end 806 is suitable. Embodiments are also possible in which comb tooth guard 880 is mounted only to the front surface of a hair cutting device and is not mounted to tapered end 806. While comb tooth guard 880 as shown in FIG. 8B is formed as a stiff wire, those skilled in the art will recognize that comb tooth guards may be formed from metal bars, wire, specially shaped metal strips, flat strips of metal, plastics, other materials, or combinations of materials. Comb tooth guard 880 as shown in FIG. 8B has a smooth rounded shape, but other shapes such as faceted shapes, triangular shapes, and other possible shapes may be used in various embodiments.

Figure 9:
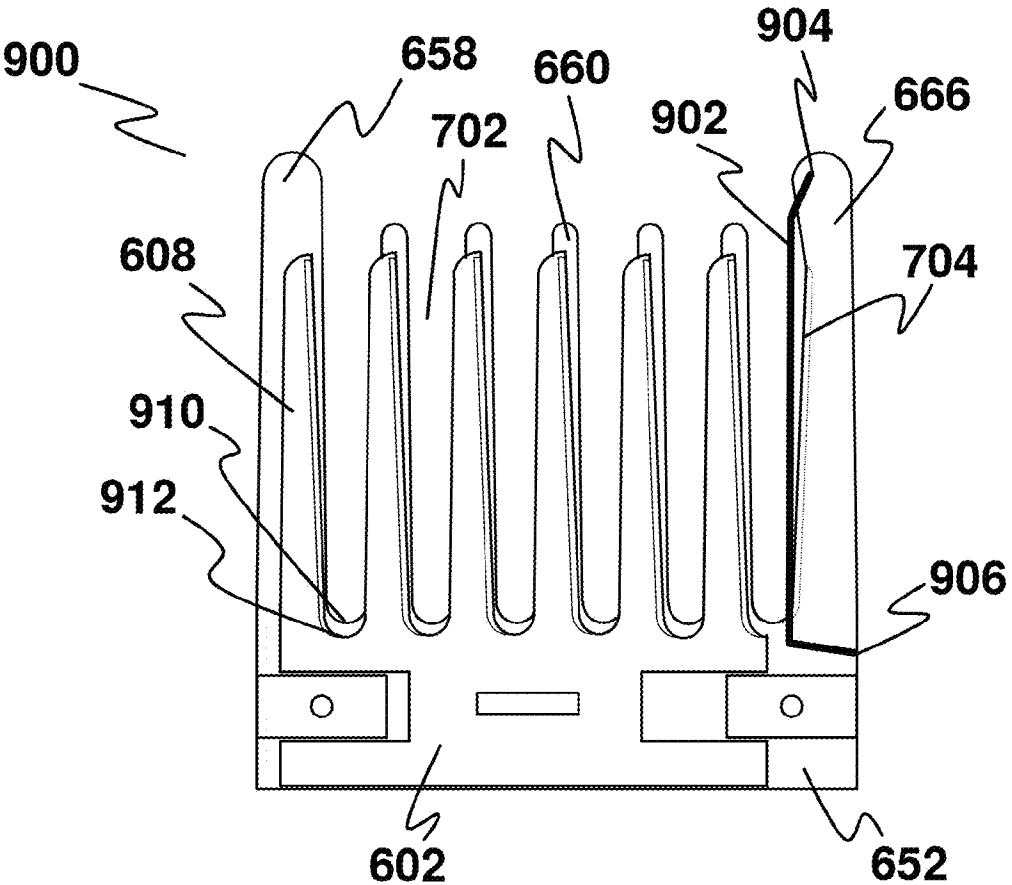
FIG. 9 is a perspective view of a comb tooth guard mounted on one embodiment of an end tooth comb according to the present disclosure.

FIG. 9 shows an embodiment of a cutter head 900 including an end comb tooth guard 902. Cutter head 900 is similar to cutter head 700 shown in FIGS. 7A, 7B, and 7C and like numbered elements in FIG. 9 perform the same functions as so numbered elements in FIGS. 6, 7A, 7B, and 7C. The embodiment of cutter head 900 includes an end comb tooth guard 902 on right end comb tooth 666. End comb tooth guard 902 may be formed from stiff wire or other suitable materials. End comb tooth guard 902 attaches to right end comb tooth 666 with front attachment 904 to the tip of right end comb tooth 666 and with side attachment 906 to the base of bottom comb 652. Other places for attachment of end comb tooth guard 902 are also possible and attachments using screws, welds, clips, snaps, glue, and other possible attachments are possible. End comb tooth guard 902 may provide benefit for some embodiments in at least partially shielding hair adjacent to right end comb tooth 666 in cutter head 900 from sharp edge 704 on right end comb tooth 666. In the course of actuation of top cutter 602, the right most cutter knife 608 may pass beneath end comb tooth guard 902 so that hair may be cut. As noted above for tooth guard 880, end comb tooth guard 902 may be constructed from a wide range of types and shapes of materials, may be formed in a wide range of shapes, and may be attached to cutter head 900 using a wide range of techniques. It is not shown in FIG. 9, but some embodiments of cutter head 900 may include a mechanical coupling between top cutter 602 and end comb tooth guard 902 so that as top cutter 602 is actuated that the position and/or shape of end comb tooth guard 902 may change through the course of actuation of top cutter 602. Those skilled in the art will recognize that such a coupling may allow end comb tooth guard 902 to beneficially adjust in position as top cutter 602 is actuated. Of course, use of flexible or "spring" materials for end comb tooth guard 902 and the use of pivots, hinges, flexures and other possible techniques for mounting end comb tooth guard 902 may be beneficial for embodiments in which end comb tooth guard 902 is coupled to top cutter 602. Some additional embodiments are also possible in which end comb tooth guard 902 is coupled to a separate actuator from the actuator used to actuate top cutter 602 so that the location and/or shape of end comb tooth guard 902 may be controlled by a hair cutting device (such as hair cutting device 200) for beneficial operation.

The embodiment of FIG. 9 also provides an example of an embodiment of a cutter head 900 in which the base regions 912 of top cutter 602 are intentionally not vertically aligned with the base regions 910 of bottom comb 652 ("vertical" here is with reference to the specific view shown in FIG. 9 and "vertical" refers to the upward direction in the view of FIG. 9). Base regions 912 between cutter knives 608 of top cutter 602 are vertically below base regions 910 between comb teeth 660 of bottom comb 652 as shown in FIG. 9. Some embodiments of cutter heads 900 may benefit from base regions of top cutters and bottom combs that are not aligned as it may ease the ability to protect hair from sharp edges during hair collection and extension and may reduce manufacturing cost and/or complexity for some embodiments.

Figure 10:
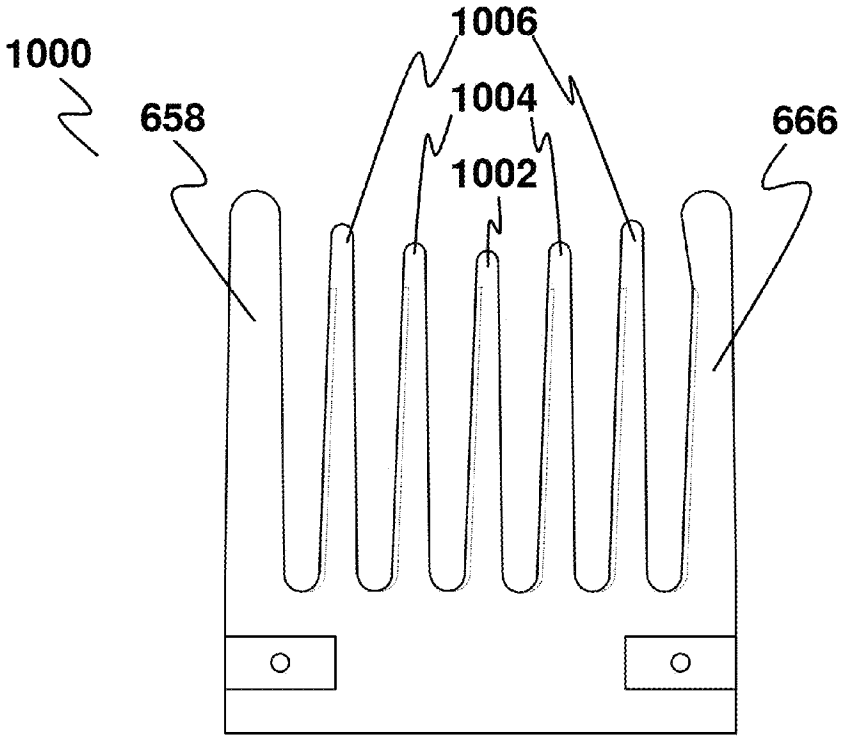
FIG. 10 shows an embodiment of a bottom comb having comb teeth of varying lengths.

FIG. 10 shows an embodiment of a bottom comb 1000 in which comb teeth have varying lengths. Bottom comb 1000 includes left end comb tooth 658, right end comb tooth 666, center comb tooth 1002, first pair of comb teeth 1004 and second pair of comb teeth 1006. In the embodiment of bottom comb 1000, center comb tooth 1002 is the shortest, first pair of comb teeth 1004 are of equal length and are somewhat longer, second pair of comb teeth 1006 are of equal length and are somewhat longer still, and left end comb tooth 658 and right end comb tooth 666 are of equal length and are even longer (and are the longest comb teeth in bottom comb 1000). The variation in comb teeth length of bottom comb 1000 form a concave pattern to the end of bottom comb 1000 that may be used to engage hair in normal operation of a cutter head including bottom comb 1000. Since bottom comb 1000 in use with an automated hair cutting system 100 may normally be used to cut hair on human heads, the concave pattern of bottom comb 1000 may be beneficial in gathering hair over the rounded surfaces of a human head and in gathering hair around ears and other features of a human head. Other combinations of comb tooth lengths forming alternative contours may be beneficial for additional embodiments of bottom combs. Cutter knives used with bottom combs such as bottom comb 1000 that have comb teeth of varying length may also have varying length, or for some embodiments, cutter knives may have uniform length even though comb teeth have varying lengths.

Figure 11:
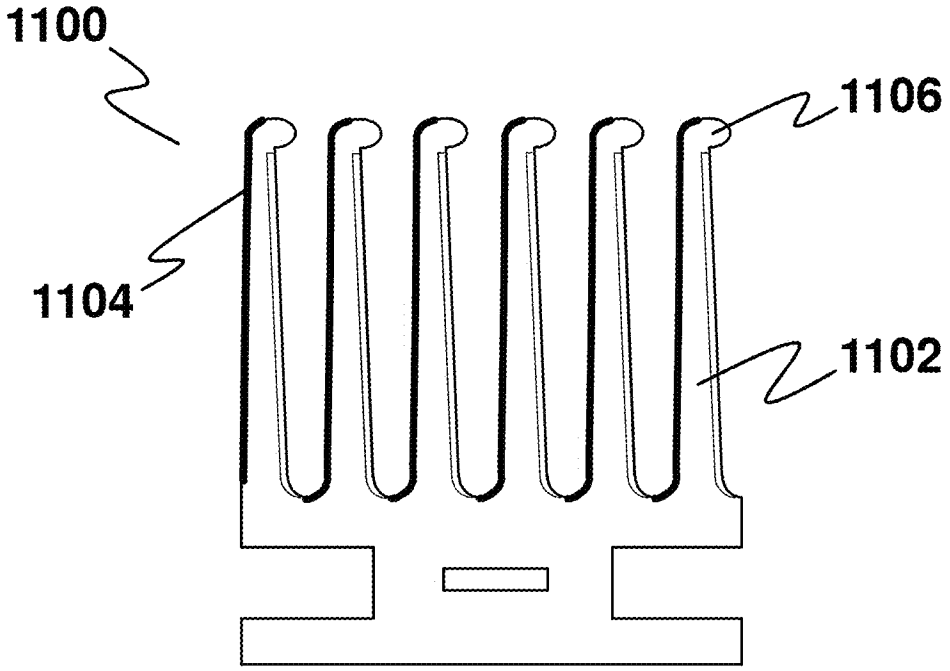
FIG. 11 shows an embodiment of a top cutter that includes reinforced edges and lateral dividers.

FIG. 11 shows an embodiment of a top cutter 1100 that includes reinforced edges 1104 to make cutter knives 1102 more rigid and lateral dividers 1106. Lateral dividers 1106 are formed as lateral extensions on the ends of cutter knives 1102. Lateral dividers 1106 serve to divide hair in a cutter head in the course of a cutting stroke of top cutter 1100 so that hair is smoothly divided into hair that is below a lateral divider 1106 and may be cut or above a lateral divider 1106 and may not be cut ("above" and "below" are used here for simplicity and refer to the regions above and below lateral divider 1106 as oriented in FIG. 11). Lateral dividers 1106 may also benefit some embodiments of cutter heads in that they may allow additional actuation to apply friction to hair without substantially exposing hair to sharp edges on cutter knives and comb teeth. As was explained above with regard to FIG. 7B, additional actuation of top cutter 602 to the left to apply additional friction to hair may expose sharp edges to hair starting at points 715. It will be clear to those skilled in the art that if the embodiment of FIG. 7B included lateral dividers 1106 that top cutter 602 could then be actuated somewhat further to the left before hair would be exposed to sharp edges. Of course, there is also possible benefit to safety of users if exposure of sharp edges is reduced due to the incorporation of lateral dividers 1106. Some embodiments of lateral dividers 1106 may include sharp edges around some parts of lateral divider 1106 and rounded corners around other parts. For example, in the embodiment of FIG. 11, lateral divider 1106 may be sharp along the bottom and have rounded corners over the top ("bottom" and "top" referring again to the regions above and below a horizontal center line through lateral divider 1106 as shown and oriented in FIG. 11). Lateral dividers 1106 are shown with a rounded end in FIG. 11, but embodiments with sharp pointed ends, faceted surfaces, or other shapes of lateral dividers are also possible. Lateral dividers 1106 may be formed from the same materials as top cutter 1100 and may be formed using similar operations, or lateral dividers 1106 may be formed separately and then welded, glued, or otherwise affixed to cutter knives 1102.

An alternative to the use of lateral dividers 1106 to shield hair from sharp edges in the course of applying friction to hair, is to instead add features to comb teeth to similarly provide a bridging effect from the tip of a cutter knife 608 to a comb tooth 660 so that sharp edges are contained as a top cutter is actuated to provide friction to hair. Instead of or in addition to providing lateral dividers 1106 on cutter knives 1102 as shown in FIG. 11, additional embodiments are possible in which features may be added to comb teeth to provide substantially similar benefits.

Reinforced edges 1104 shown on cutter knives 1102 in FIG. 11 may be formed from metals, plastics, ceramics, or other materials and may be welded, glued, or otherwise affixed to cutter knives 1102. Reinforced edges 1104 may also be formed as part of cutter knives 1102 and may be formed through bending, coining, stamping, or other processes to create a thickened edge that provides stability and/or stiffness to cutter knives 1102. Reinforced edges 1104 as shown in FIG. 11 are only one possible way that top cutter 1100 may be stiffened and/or stabilized. Those skilled in the art will recognize that many common techniques to reinforce, stabilize, strengthen, support, or otherwise benefit a top cutter 1100 are possible.

Figure 12:
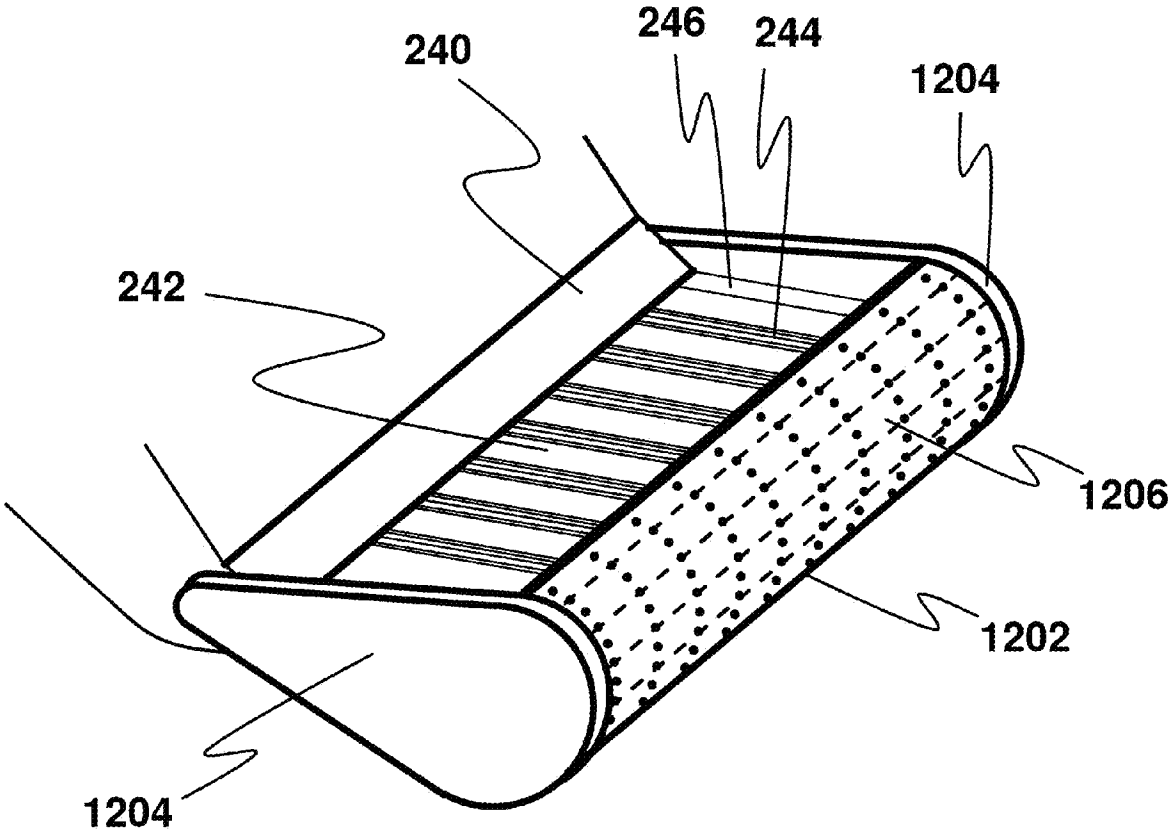
FIG. 12 shows the cutter head of FIG. 2B with a shaving accessory attached.

FIG. 12 shows cutter head 240 of FIG. 2B with a shaving accessory 1202 attached. The shaving accessory 1202 is powered by cutter head 240 and attaches so that the cutter head 240 may be easily converted to provide a shaving function. Those skilled in the art will recognize that various embodiments of shaving accessories 1202 may be used with a wide variety of embodiments of cutter heads. Shaving is a common part of hair care and it is common to shave the back on one's neck, sides of the face, and possibly some other regions of a person's face in the course of a haircut. Since a hair cutting device 200 used in an automated hair cutting system 100 may include sensors, cameras, signal processing functions, etc., it is beneficial to provide a shaving function without the need to create an entirely new hair cutting device for the purpose of shaving. That is, a shaving accessory 1202 allows the elements of a hair cutting device 200 that are common to both hair cutting and shaving to be utilized without substantially adding significant cost. And for the case of an automated hair cutting system 100, such a shaving accessory 1202 allows for control of the shaving function in an automated and beneficial fashion. Shaving accessory 1202 is shown in FIG. 12 attached to cutter head 240. Shaving screen 1206 provides openings through which hairs extend, in the course of shaving, so that they may be cut by knives (not shown) on the other side of shaving screen 1206. Shaving screen 1206 may be made from stainless steel, ceramics, plastics, or other materials and may be similar to those used on many commonly available electric shavers. Shaving screen is shown with a rounded contour, but many shapes are possible including flat, faceted, and other contours. End plates 1204 on either end of shaving accessory 1202 contact end comb teeth 246 and possibly other elements of cutter head 240 to attach shaving accessory 1202 to cutter head 240. The bottom portion of shaving accessory 1202 not visible in FIG. 12 may also contact comb teeth 242. Shaving accessory 1202 may attach to cutter head 240 using snaps, glides, guides, catches, elastic, indentations, electrically actuated magnets, permanent magnets, levers, cams, screws, Velcro, adhesives, or other possible techniques.

Cutter knives 244 extend behind shaving screen 1206 and may directly contact and actuate the knives inside shaving accessory 1202 to facilitate shaving action or mechanisms including levers, gears, cams, etc. may be utilized. A hair cutting device 200 incorporating cutter head 240 and shaving accessory 1202 may be able to detect the presence of shaving accessory 1202 and may beneficially actuate cutter knives 244 to benefit shaving action. For example, cutter knives may be actuated with limited travel to reduce wear; or may be actuated at higher speed to improve shaving action; or may be otherwise actuated to provide benefit when a shaving accessory 1202 is present. A hair cutting device 200 incorporating cutter head 240 and shaving accessory 1202 may use sensors such as magnetic sensors, a camera (such as camera 216 shown in FIG. 2), optical sensors, or other sensors to detect the presence of shaving accessory 1202. An operator, such as user 102 may also indicate to automated hair cutting system 100 through interaction with electronic computing device 106 or other elements of an automated hair cutting system 100 that shaving accessory 1202 is present. Those skilled in the art will recognize that in addition to a shaving accessory 1202, other accessories with beneficial shapes and constructions may be used in a similar fashion to attach and be powered by a cutter head to provide useful functions for hair trimmers, shavers, clippers, cutters designed to thin hair, or other beneficial functions in conjunction with an automated hair cutting system 100.

Disclosed hereinabove are embodiments of cutter heads for use with automated hair cutting system which enable hair to be beneficially manipulated and cut. Embodiments include a cutter head that allow actuation in one direction to apply friction to hair so that it may be more easily manipulated, and to cut hair when actuated in an alternate direction. Improved designs of cutter heads are provided including improvements in both top cutter and bottom comb designs. Use of top cutter knives and bottom comb teeth that have slanted edges allow hair to be cut through the course of a longer stroke of the cutter knives reduce peak load on an actuator driving a cutter head and provides smoother operation with less vibration. Extension of bottom comb teeth beyond the tips of cutter knives in a cutter head improve safety and allow hair to be more easily collected in a cutter head. Comb tooth guards may be beneficial in some embodiments to improve safety or improve the ability to manipulate hair. Use of a guard along the end comb tooth of a bottom comb may benefit operation of some embodiments. Variable length bottom comb teeth may be used in some embodiments to generate a contoured shape of bottom comb teeth tips to improve the ability to collect hair in a cutter head. Cutter knives including a reinforced edge may improve rigidity of a cutter knife and improve cutting action. The addition of lateral dividers to the tips of cutter knives may improve safety, reduce the likelihood of hair snagging in a cutter head, and improve cutting action. And a shaving accessory or other accessory may be applied to a cutter head so that precision shaving may be enabled.

Those skilled in the art to which this application relates will appreciate that other and further additions, deletions, substitutions and modifications may be made to the described embodiments.

The invention claimed is:

1. A cutter head for use with a hair cutting system, the cutter head comprising:

a top comb comprising a plurality of top cutting members, each extending from a base region of the top comb, each of the plurality of top cutting members comprising:

an elongated length;

a distal tip;

a bottom surface;

a sharp edge extending along the bottom surface, the sharp edge beginning proximal the base region of the top comb and extending to a point proximal the distal tip; and a dull edge extending along the bottom surface, the dull edge beginning proximal the base region of the top comb and extending to said point proximal the distal tip; and a bottom comb comprising a plurality of bottom cutting members, each extending from a base region of the bottom comb, each of the plurality of bottom cutting members comprising at least one dull edge;

wherein said cutter head is configured so that said cutter head may be actuated so that hair may be collected into said cutter head between a dull edge of at least one of said plurality of top cutting members and a dull edge of at least one of said plurality of bottom cutting members;

wherein said top comb and said bottom comb slidingly engage along an interfacing surface, said interfacing surface comprising each said bottom surface of said each of the plurality of top cutting members;

wherein said top comb is configured so that any straight line normal to said interfacing surface and extending through said interfacing surface intersects said interfacing surface at only a single point of said interfacing surface; and wherein upon actuation of said cutter head, the top cutting members and bottom cutting members interact to manipulate or cut hair.

2. The cutter head according to claim 1, wherein the top and bottom cutting members comprise rounded distal tips.

3. The cutter head according to claim 1, wherein each dull edge of the too cutting members and the bottom cutting members comprises a rounded contour, a chamfered contour, a non-uniformly rounded contour, or a contour that is otherwise formed or finished so that hair contacting said dull edge may be manipulated.

4. A hair cutting device comprising the cutter head according to claim 1.

5. A cutter head for use with a hair cutting system, the cutter head comprising:

a bottom comb comprising a plurality of bottom cutting members, each extending from a base region of the bottom comb, each of the plurality of bottom cutting members comprising:

an elongated length;

a distal tip;

a top surface;

a sharp edge extending along the top surface, the sharp edge beginning proximal the base region of the bottom comb and extending to a point proximal the distal tip; and a dull edge extending along the top surface, the dull edge beginning proximal the base region of the bottom comb and extending to said point proximal the distal tip; and a top comb comprising a plurality of top cutting members, each extending from a base region of the top comb, each of the plurality of top cutting members comprising at least one dull edge;

wherein said cutter head is configured so that said cutter head may be actuated so that hair may be collected into said cutter head between a dull edge of at least one of said plurality of bottom cutting members and a dull edge of at least one of said plurality of top cutting members;

wherein said bottom comb and said top comb slidingly engage along an interfacing surface, said interfacing surface comprising each said top surface of said each of the plurality of bottom cutting members;

wherein said bottom comb is configured so that any straight line normal to said interfacing surface and extending through said interfacing surface intersects said interfacing surface at only a single point of said interfacing surface; and wherein upon actuation of said cutter head, the top cutting members and bottom cutting members interact to manipulate or cut hair.

6. The cutter head according to claim 5, wherein each dull edge of the top cutting members and the bottom cutting members comprises a rounded contour, a chamfered contour, a non-uniformly rounded contour, or a contour that is otherwise formed or finished so that hair contacting said dull edge may be manipulated.

7. A hair cutting device comprising the cutter head according to claim 5.

8. A cutter head for use with a hair cutting system, the cutter head comprising:

a top comb comprising a plurality of top cutting members, each of the plurality of top cutting members comprising:

an elongated length; and a cross-sectional shape perpendicular to the elongated length, the cross-sectional shape having a bottom edge extending from a dull end to a sharp end; and a bottom comb comprising a plurality of bottom cutting members, each of the plurality of bottom cutting members comprising:

an elongated length; and a cross-sectional shape perpendicular to the elongated length, the cross-sectional shape having a top edge extending from a dull end to a sharp end;

and wherein said cutter head is configured so that said cutter head may be actuated so that at least one of said plurality of top cutting members at least partially aligns with a first bottom cutting member so that hair may be collected into said cutter head;

wherein said cutter head is configured so that said cutter head may be actuated so that said at least one of said plurality of top cutting members interacts with a second bottom cutting member so that hair may be compressed between a dull edge of said at least one of said plurality of top cutting members and a dull edge of said second bottom cutting member;

wherein said cutter head is configured so that said cutter head may be actuated so that said at least one of said plurality of top cutting members interacts with a third bottom cutting member so that hair may be cut; and wherein said first bottom cutting member, said second bottom cutting member, and said third bottom cutting member, are each individual and different elements of said plurality of bottom cutting members.

9. The cutter head according to claim 8, wherein said dull end of said cross-sectional shape having a bottom edge extending from a dull end to a sharp end, further comprises a chamfered shape, a rounded shape, a non-uniformly rounded shape, or a shape that is otherwise formed or finished so that hair contacting said dull end of said cross-sectional shape having a bottom edge extending from a dull end to a sharp end may be manipulated; or wherein said dull end of said cross-sectional shape having a top edge extending from a dull end to a sharp end, further comprises a chamfered shape, a rounded shape, a non-uniformly rounded shape, or a shape that is otherwise formed or finished so that hair contacting said dull end of said cross-sectional shape having a top edge extending from a dull end to a sharp end may be manipulated.

10. A hair cutting device comprising the cutter head according to claim 8.

* * * * *